US008716949B2

(12) United States Patent
Watanabe et al.

(10) Patent No.: US 8,716,949 B2
(45) Date of Patent: May 6, 2014

(54) LIGHTING DEVICE FOR SOLID-STATE LIGHT SOURCE AND ILLUMINATION APPARATUS USING SAME

(75) Inventors: Koji Watanabe, Kyoto (JP); Hiromitsu Mizukawa, Osaka (JP)

(73) Assignee: Panasonic Corporation, Osaka (JP)

( * ) Notice: Subject to any disclaimer, the term of this patent is extended or adjusted under 35 U.S.C. 154(b) by 85 days.

(21) Appl. No.: 13/456,343

(22) Filed: Apr. 26, 2012

(65) Prior Publication Data

US 2012/0286686 A1 Nov. 15, 2012

(30) Foreign Application Priority Data

May 12, 2011 (JP) ..... 2011-107319

(51) Int. Cl.
*H05B 37/02* (2006.01)

(52) U.S. Cl.
USPC ..... 315/224; 315/226

(58) Field of Classification Search
None
See application file for complete search history.

(56) References Cited

U.S. PATENT DOCUMENTS

| | | | | |
|---|---|---|---|---|
| 6,329,761 | B1 * | 12/2001 | Melis et al. | 315/209 R |
| 6,949,885 | B2 * | 9/2005 | Hamamoto et al. | 315/200 R |
| 7,071,762 | B2 | 7/2006 | Xu et al. | |
| 2001/0030514 | A1 * | 10/2001 | Takahashi et al. | 315/219 |
| 2011/0057576 | A1 | 3/2011 | Otake et al. | |
| 2011/0062888 | A1 * | 3/2011 | Bondy et al. | 315/294 |
| 2011/0068706 | A1 | 3/2011 | Otake et al. | |
| 2011/0140621 | A1 * | 6/2011 | Yi et al. | 315/224 |

FOREIGN PATENT DOCUMENTS

| | | | |
|---|---|---|---|
| CN | 1729722 | A | 2/2006 |
| CN | 102014543 | A | 4/2011 |
| JP | 2002-016290 | A | 1/2002 |
| JP | 2006-511078 | | 3/2006 |
| JP | 2009-232623 | | 10/2009 |
| JP | 2011-65922 | | 3/2011 |

OTHER PUBLICATIONS

Chinese Office Action dated Jan. 14, 2014 issued in corresponding Chinese application No. 2012 10147336.1 and the English translation thereof.

* cited by examiner

*Primary Examiner* — Crystal L Hammond
(74) *Attorney, Agent, or Firm* — Bacon & Thomas, PLLC

(57) ABSTRACT

A lighting device for lighting a solid-state light source includes: a DC power circuit unit for converting a power of an input DC power source using a switching element and flowing a current through a solid-state light source; and a control unit for performing a first switching control in which the switching element is turned on/off at a first high frequency and a second switching control in which an ON/OFF operation of the switching element is intermittently stopped at a second frequency lower than the first frequency of the first switching control. When the current flowing through the solid-state light source is changed, the second frequency is varied.

10 Claims, 13 Drawing Sheets

LIGHTING DEVICE FOR SOLID-STATE LIGHT SOURCE AND ILLUMINATION APPARATUS USING SAME

FIELD OF THE INVENTION

The present invention relates to a lighting device for lighting a solid-state light source, such as an LED (Light Emitting Diode), and to an illumination apparatus using the lighting device.

BACKGROUND OF THE INVENTION

As a prior art, Japanese Patent Application Publication No. 2006-511078 (JP2006-511078A) discloses a power supply assembly for an LED illumination module that performs dimming control on an LED by combining low-frequency PWM (Pulse Width Modulation) control with a high-frequency PWM control. This device includes a switch mode converter for supplying a constant current to the LED illumination module, and a dual PWM signal composed of low frequency bursts of high frequency pulses is provided to the control switch of the switch mode converter. By varying the average current flowing through the LED illumination module as the low-frequency component of the dual PWM signal is varied, the intensity of a light outputted from the LED illumination module is changed.

SUMMARY OF THE INVENTION

In a technique disclosed in JP2006-511078A, the switch mode converter disposed between a DC power source and the LED illumination module is operated in continuous mode (see FIG. 12 in the same document), so that the duration of an LED current of the LED illumination module is controlled by using a low-frequency PWM control while the magnitude of the LED current is controlled by using the high-frequency PWM control. Further, a PWM comparator for comparing a sawtooth wave voltage of a predetermined frequency with a reference voltage is used to generate a PWM signal, so that both frequencies for the high-frequency PWM control and the low-frequency PWM control are fixed.

Meanwhile, when the switch mode converter disposed between the DC power source and the LED illumination module is operated in zero-crossing mode having high efficiency, a high oscillation frequency changes by a pulse width control in the high-frequency PWM control, as shown in FIGS. 2A to 2C. That is, when a peak current is high, a high oscillation frequency becomes lower, whereas when the peak current is low, the high oscillation frequency becomes higher.

For example, if the frequency for the low-frequency PWM control is set to be higher according to the case where the peak current is low, the number of ON pulses of the high-frequency, included in a burst ON period when the peak current is high, is reduced, and the resolution of dimming is deteriorated.

In contrast, if the frequency for the low-frequency PWM control is set to be lower according to the case where the peak current is high, there is a problem in that a current idle period is unnecessarily lengthened when the peak current is low, and thus flickering is visible.

In view of the above, the present invention provides a lighting device for lighting a solid-state light source, the lighting device appropriately controlling switching frequency, thus reducing flickering occurring in a low luminance level while ensuring the resolution of burst dimming in a high luminance level.

In accordance with an aspect of the present invention, there is provided a lighting device for lighting a solid-state light source including: a DC power circuit unit for converting a power of an input DC power source using a switching element and flowing a current through a solid-state light source; and a control unit for performing a first switching control in which the switching element is turned on/off at a first high frequency, and a second switching control in which an ON/OFF operation of the switching element is intermittently stopped at a second frequency which is lower than the first frequency of the first switching control.

When the current flowing through the solid-state light source is changed, the second frequency is varied.

When the first frequency becomes higher, the control unit may raise the second frequency.

When the current flowing through the solid-state light source is less than a predetermined value, the control unit may control the first frequency to be almost constant.

When the current flowing through the solid-state light source is less than a predetermined value, the control unit may control an ON-time period of the switching element in the first switching control to be almost constant.

When the current flowing through the solid-state light source is less than a predetermined value, the control unit may raise the second frequency as the first frequency becomes higher, whereas when the current flowing through the solid-state light source is equal to or greater than the predetermined value, the control unit may control the second frequency to be almost constant.

The DC power circuit unit is preferably configured such that an inductor is connected in series to the switching element and the current flows through the solid-state light source by using a charging current and a discharging current of the inductor, and the switching element is controlled by the first switching control so that the current of the inductor is in a zero-crossing operation or in a discontinuous operation close to the zero-crossing operation.

The DC power circuit unit may have capacitive impedance connected in parallel to the solid-state light source and the second frequency is preferably set such that the current flowing through the solid-state light source forms a continuous waveform.

Herein, said forming continuous waveform includes a case in which a current variation rate defined by (maximum current−minimum current)÷average current is equal to or less than a specific value (e.g., equal to or less than 1).

The lighting device may further include a capacitor for smoothing a control signal of the second frequency, wherein the first frequency is set based on a voltage of the capacitor.

In accordance with another aspect of the present invention, there is provided an illumination apparatus including the lighting device described above.

In accordance with the present invention, since changing the current flowing through the solid-state light source causes the frequency of the second switching control to vary, the flickering of light is not visible even if the current flowing through the solid-state light source is small. Further, a situation in which the number of high-frequency pulses that are controllable by the second switching control is excessively reduced can be avoided, and thus the resolution of dimming can be ensured.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments in accordance with the present invention will be described with reference to the accompanying drawings which form a part hereof.

Embodiment 1

Figure 1:
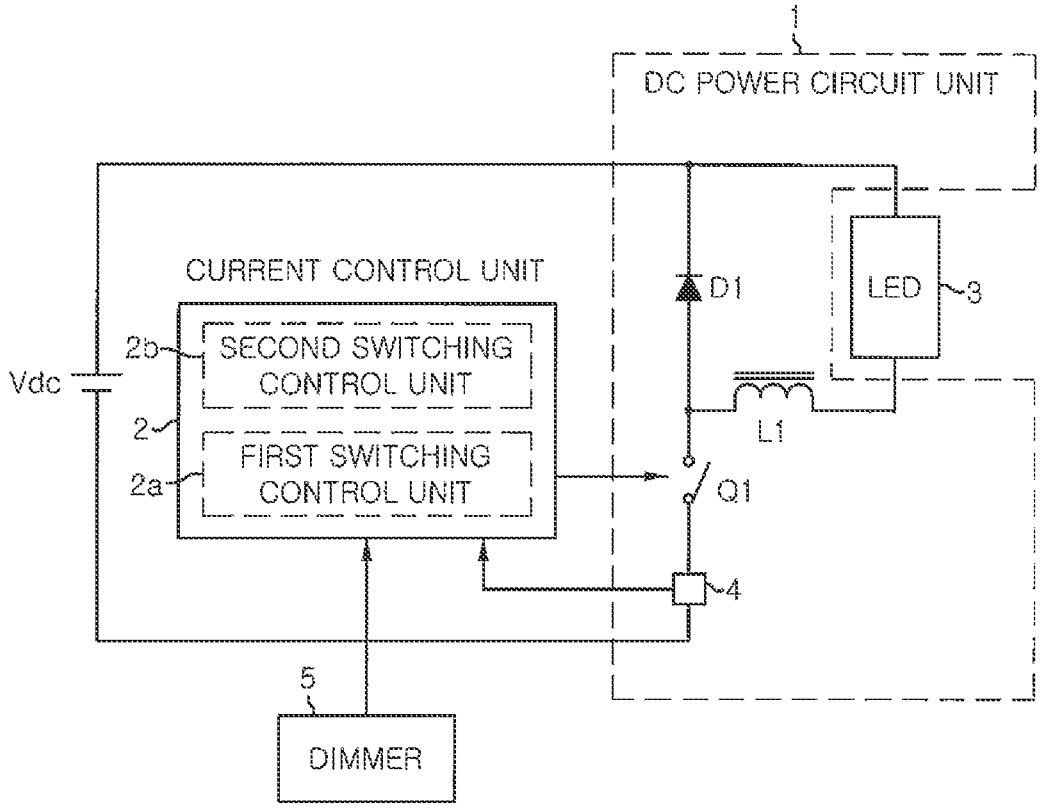
FIG. 1 is a circuit diagram of a lighting device for a solid-state light source in accordance with a first embodiment of the present invention.

FIG. 1 is a circuit diagram of a lighting device for a solid-state light source in accordance with a first embodiment of the present invention. The lighting device includes an input DC power source Vdc, a DC power circuit unit 1 and a current control unit 2. The lighting device configures an illumination apparatus. The DC power circuit unit 1 is connected to the input DC power source Vdc. The DC power circuit unit 1 includes a recovery diode D1, an inductor L1, a switching element Q1 and a current detection unit 4. The DC power circuit unit 1 is a switching power supply circuit for converting the power of the input DC power source Vdc by using the switching element Q1, and supplying a DC current to a solid-state light source 3, such as an LED (or an OLED (Organic Light Emitting Diode)). Herein, a buck chopper circuit (buck converter) is used as the DC power circuit unit 1.

The configuration of the buck chopper circuit is well known, and is configured such that a series circuit of the inductor L1, the switching element Q1 and the current detection unit 4 is connected between the anode and the cathode of the input DC power source Vdc via the solid-state light source 3, and the recovery diode D1 is connected in parallel to a series circuit of the solid-state light source 3 and the inductor L1 to form a closed circuit.

The operation of the buck chopper circuit is also well known, and is configured such that when the switching element Q1 is turned on, a gradually increasing current flows along a path of the anode of the input DC power source Vdc→the solid-state light source 3→the inductor L1→the switching element Q1→the current detection unit 4→the cathode of the input DC power source Vdc, and then an energy is stored in the inductor L1. When the switching element Q1 is turned off, a gradually decreasing current flows along a path of the inductor L1→the recovery diode D1→the solid-state light source 3→the inductor L1, due to a voltage induced in the inductor L1, and then the energy in the inductor L1 is discharged.

An operation in which the switching element Q1 is turned on before the discharging of the energy from the inductor L1 is completed is called a continuous mode, an operation in which the switching element Q1 is turned on in timing at which the discharging of the energy from the inductor L1 is completed is called a critical mode, and an operation in which the switching element Q1 is turned on after passing through an idle period from the completion of the discharging of the energy from the inductor L1 is called a discontinuous mode. The present invention may use any of the above modes, but the mode having higher power conversion efficiency is the critical mode. The critical mode is occasionally called a zero-crossing mode or a boundary mode.

The switching element Q1 is turned on or off at a high frequency by the current control unit 2 including a first switching control unit 2*a* and a second switching control unit 2*b*. When the switching element Q1 is in an ON state, the gradually increasing current that flows through the switching element Q1 is detected by the current detection unit 4. The current value detected by the current detection unit 4 (current detection value) is compared with a predetermined threshold value set by the current control unit 2. When the current detection value reaches the predetermined threshold value, the switching element Q1 is turned off. Accordingly, the peak value of the current flowing through the switching element Q1 is set to the predetermined threshold value.

Figure 2A:
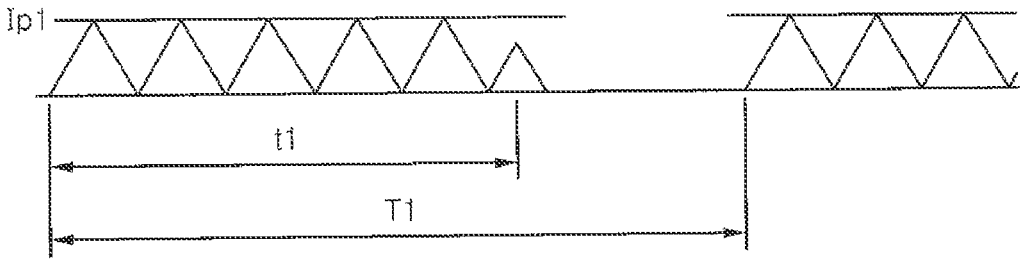
FIGS. 2A to 2C show waveform diagrams of an operation in accordance with the first embodiment.
Figure 2B:
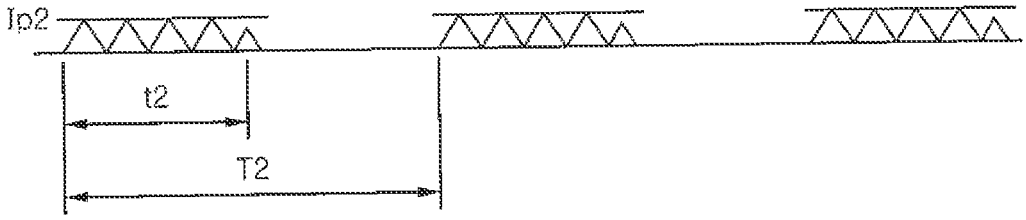
Figure 2C:
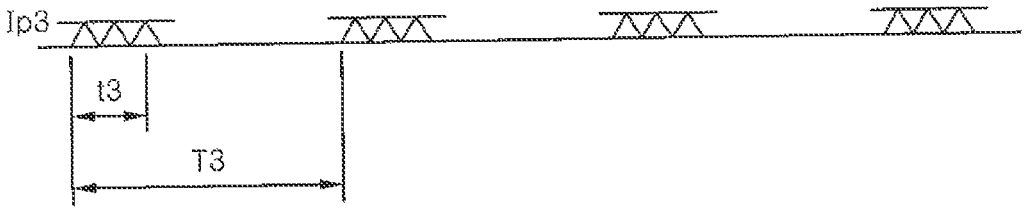

FIGS. 2A to 2C show the waveform of current flowing through the inductor L1 by the ON/OFF operations of the switching element Q1. During a period in which the current flowing through the inductor L1 gradually increases, the current is identical to the current flowing through the switching element Q1. Meanwhile, during a period in which the current flowing through the inductor L1 gradually decreases, the current is identical to the current flowing through the recovery diode D1. In the present embodiment, the current flowing through the inductor L1 is exemplified as a current in the above-described critical mode, but the mode may be either continuous mode or discontinuous mode.

FIG. 2A illustrates the case where a predetermined threshold value Ip1 set by the current control unit 2 is high, FIG. 2B illustrates the case where a predetermined threshold value Ip2 is relatively lower, and FIG. 2C illustrates the case where a threshold value Ip3 is further lower. The predetermined threshold values Ip1, Ip2, and Ip3 set by the current control unit 2 are determined depending on a dimming signal provided from a dimmer 5 to the current control unit 2.

Time periods t1, t2, and t3 shown in FIGS. 2A to 2C show burst ON periods in which a high-frequency ON/OFF signal is outputted from the current control unit 2 to the switching element Q1. Herein, the "burst ON period" refers to a period in which the high-frequency ON/OFF operations of the switching element Q1 are permitted. During the burst ON period, the switching element Q1 is biased (activated), and during the remaining periods, the switching element Q1 is unbiased (deactivated). The burst ON period is set by the current control unit 2 depending on the dimming signal provided from the dimmer 5 to the current control unit 2.

In FIGS. 2A to 2C respectively present the case where the burst ON period t1 of the switching element Q1 is long, the case where the burst ON period t2 is relatively shorter and the case where the burst ON period t3 is further shorter.

A burst-ON operation is repeated at a predetermined frequency (for example, several hundred Hz to several kHz). The frequency of the repetition is set to be lower than the high frequency ON/OFF operations (several tens of kHz) of the switching element Q1 in the DC power circuit unit 1.

T1, T2, and T3 in FIGS. 2A to 2C denote cycles in which the burst-ON operation is repeated. Herein, T1>T2>T3 and t1/T1>t2/T2>t3/T3 are satisfied.

The current control unit 2 reads the dimming signal provided from the dimmer 5, and sets the peak values Ip1 to Ip3 of the current flowing through the switching element Q1 while setting the burst-ON periods t1 to t3 in which the high-frequency ON/OFF operations of the switching element Q1 are permitted, as shown in FIGS. 2A to 2C. When the peak values Ip1 to Ip3 of the current are controlled by as a first switching control unit 2*a*, and the burst-ON periods t1 to t3 are controlled by a second switching control unit 2*b*, it is possible to enable a stable dimming operation in a wide range with combination of the controls.

For example, when a dimming ratio is high (bright), the peak value Ip1 of the current flowing through the switching element Q1 is set to be high while the a ratio of the burst-ON period (t1/T1) are set to be large, as shown in FIG. 2A. Further, when the dimming ratio is low (dark), the peak value Ip3 of the current flowing through the switching element Q1 is set to be low while a ratio of the burst-ON period (t3/T3) is set to be small, as shown in FIG. 2C. In this way, it is possible to perform dimming over a wide range by combining and applying the first and second switching control units 2*a* and 2*b*.

Further, when the peak current Ip3 is low, as shown in FIG. 2C, flickering is easily visible due to the characteristics of the human eye. Since, however, the burst-ON cycle T3 is shortened and an idle period (T3−t3) for the current of the inductor L1 is reduced, an idle period for the current flowing through the solid-state light source 3 is also shortened, thus making it difficult for flickering to be visible.

Furthermore, as shown in FIG. 2A, when the peak current Ip1 is high, the burst-ON cycle T1 is lengthened, so that it is possible to increase the number of high-frequency pulses included in one cycle, thus improving the resolution of dimming.

Figure 3:
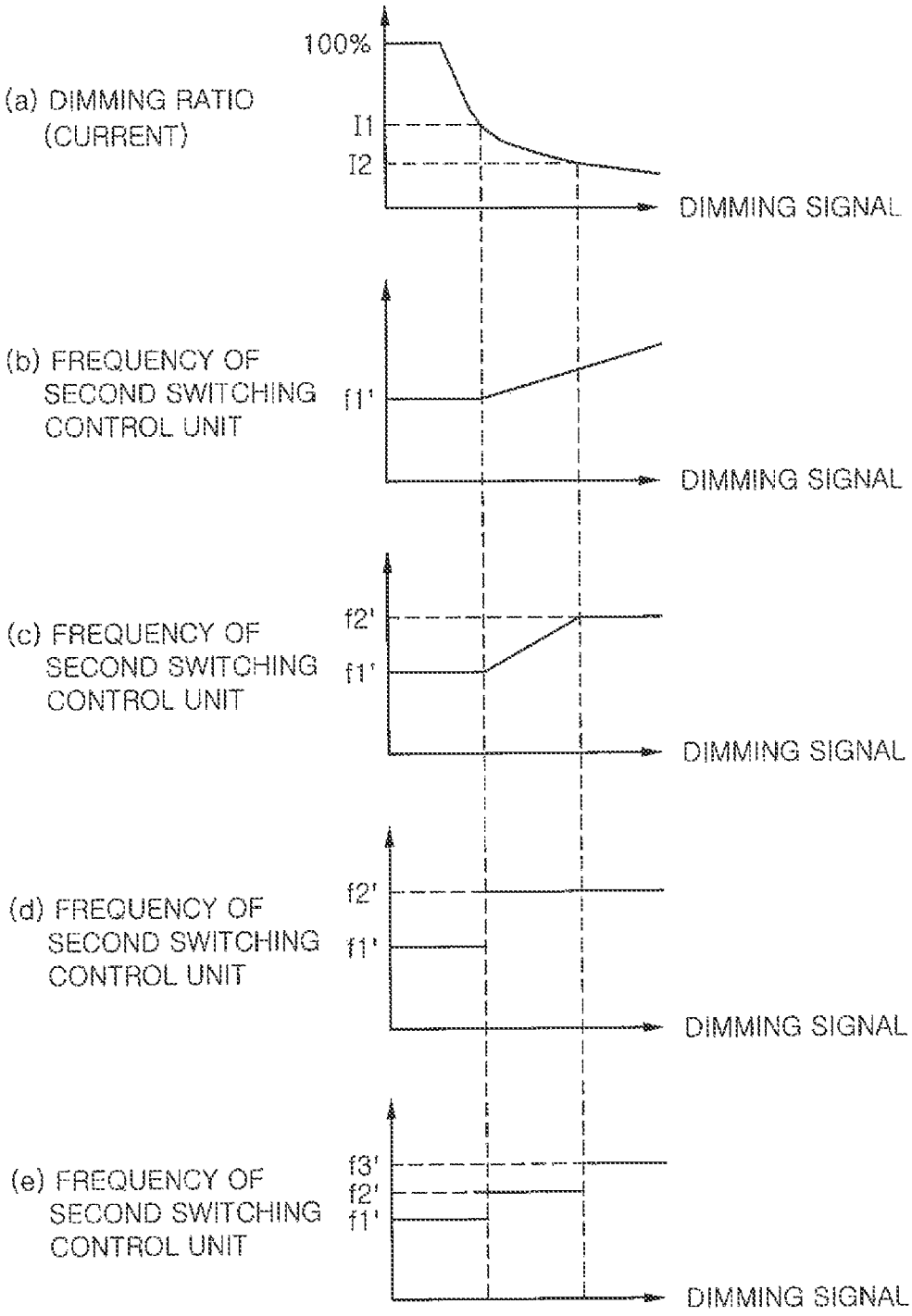
FIG. 3 is a diagram showing the operation in accordance with the first embodiment of the present invention.

A relationship between the frequency of burst ON operation and the dimming signal provided from the dimmer 5 is illustrated in FIG. 3. (a) of FIG. 3 presents a dimming ratio (current) according to the dimming signal, which shows the average of current flowing through the solid-state light source 3. This example shows that as the dimming signal from the dimmer 5 increases, the dimming ratio decreases.

In all of control examples shown in (b) to (e) of FIG. 3, when the dimming ratio is equal to or greater than a predetermined value I1, the frequency of the second switching control unit 2*b* (the frequency of burst ON operation) is kept almost constant (f1'). Further, when the dimming ratio is less than the predetermined value I1, the frequency of the second switching control unit 2*b* becomes higher than f1'.

In the control example in (b) of FIG. 3, when the dimming ratio is less than the predetermined value I1, the frequency of the second switching control unit 2*b* is continuously raised as the current flowing through the solid-state light source 3 is decreased. In the case of the control example in (b) of FIG. 3, it is also preferable that I1=100%. In that case, the frequency of the second switching control unit 2*b* always changes according to the current flowing through the solid-state light source 3.

In the control example in (c) of FIG. 3, when the dimming ratio is less than a predetermined value I2, the frequency of the second switching control unit 2*b* is kept almost constant (f2'). Further, when the dimming ratio is equal to or greater than I2 and is less than I1, the frequency of the second switching control unit 2*b* is continuously raised as the current flowing through the solid-state light source 3 is decreased.

In the control examples in (d) and (e) of FIG. 3, when the dimming ratio is less than the predetermined value I1, the frequency of the second switching control unit 2*b* is raised in stages. Although the frequency is varied in two stages in (d) of FIG. 3 and in three stages in (e) of FIG. 3, the number of stages for variation is not limited, and the number of stages equal to or greater than four stages may be used.

In the control example in (d) of FIG. 3, when the dimming ratio is less than the predetermined value I1, the frequency of the second switching control unit 2*b* is kept almost constant (f2').

In the control example in (e) of FIG. 3, when the dimming ratio is less than the predetermined value I2, the frequency of the second switching control unit 2*b* is kept almost constant (f3'). Further, when the dimming ratio is equal to or greater than I2 and is less than I1, the frequency of the second switching control unit 2*b* is kept almost constant (f2').

Moreover, the input DC power Vdc may be a DC voltage obtained by rectifying and smoothing a commercial AC power. The lighting device in accordance with the embodiment of the present invention may be applied to an illumination apparatus having a dimming function for home use or office use.

Embodiment 2

Figure 4:
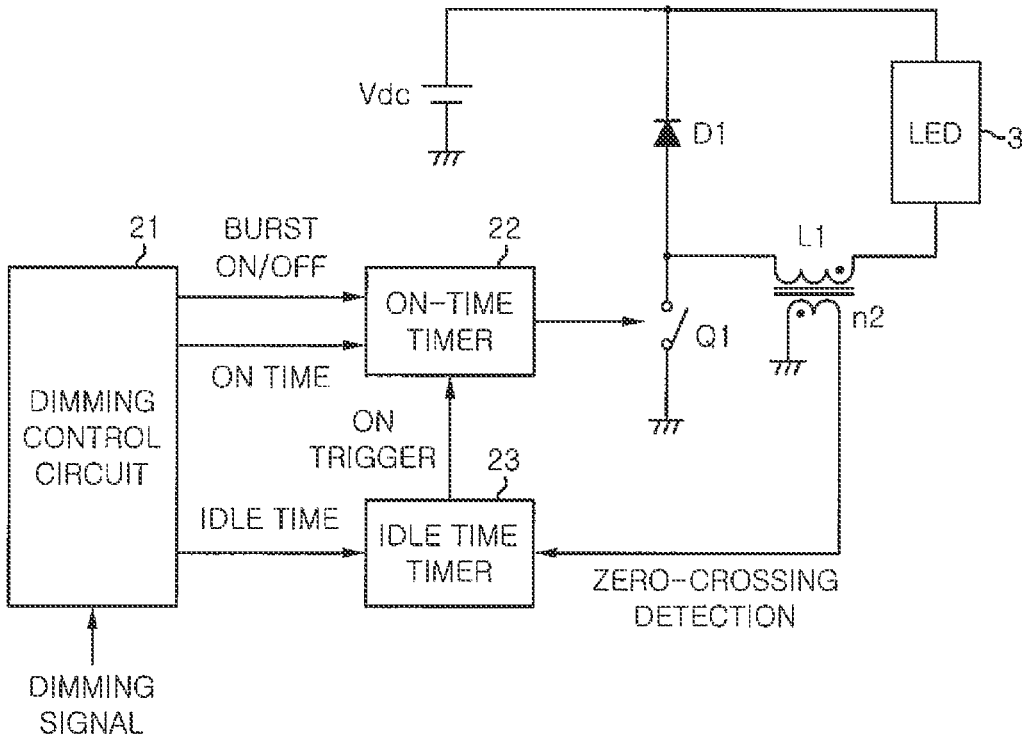
FIG. 4 is a circuit diagram of a lighting device for a solids state light source in accordance with a second embodiment of the present invention.

FIG. 4 is a circuit diagram of a lighting device for a solids state light source in accordance with a second embodiment of the present invention. The principal configuration of the circuit is similar to that of FIG. 1. In the present embodiment, a current control unit can be operated even in discontinuous mode shown in FIG. 5, in addition to critical mode shown in FIGS. 2A to 2C. The current control unit includes an ON-time timer 22 for setting an ON time shown in FIG. 5, an idle time timer 23 for setting an idle time shown in FIG. 5, and a dimming control circuit 21 for assigning control signals to the timers. The dimming control circuit 21 assigns a burst ON/OFF control signal, required to intermittently stop the operation of the ON-time timer 22 at a low frequency, to the ON-time timer 22 while instructing the ON time of the ON-time timer 22 and the idle time of the idle time timer 23 in response to a dimming signal from the dimmer.

Hereinafter, a control in which the switching element Q1 is on/off controlled with a high frequency is referred to as a "first switching control" and a control in which the switching element Q1 is intermittently stopped with a low frequency is referred to as a "second switching control"

For example, when the burst ON/OFF control signal is at a high level, the operation of the ON-time timer 22 is permitted, whereas when the burst ON/OFF control signal is at a low level, the operation of the ON-time timer 22 is prohibited and the switching element Q1 is maintained in an OFF state.

When the burst ON/OFF control signal is at a high level, if the ON-time timer 22 receives an ON trigger from the idle time timer 23, it outputs a pulse voltage having a time period corresponding to a command voltage of an ON-time set terminal. This switching element Q1 is turned on or off in response to the pulse voltage.

When the switching element Q1 is turned on by the ON-time timer 22, a gradually increasing current IQ1 flows along a path of the anode of the input DC power source Vdc→the solid-state light source 3→the inductor L1→the switching element Q1→the cathode of the input DC power source Vdc, and then an energy is stored in the inductor L1. If a predetermined ON time has elapsed, and the switching element Q1 has been turned off, a gradually decreasing current ID1 flows along a path of the inductor L1→the diode D1→the solid-state light source 3→the inductor L1, and the energy stored in the inductor L1 is discharged.

While the energy of the inductor L1 is being continuously discharged, a flyback voltage is induced in the secondary coil n2 of the inductor L1. If the charging of the energy from the inductor L1 has been completed, the flyback voltage of the secondary coil n2 disappears. Accordingly, zero-crossing in the current flowing through the inductor L1 is detected. Then, the idle time timer 23 starts to perform a counting operation. If the counting operation for a predetermined idle time is completed, an ON trigger is assigned to the ON-time timer 22.

Figure 5:
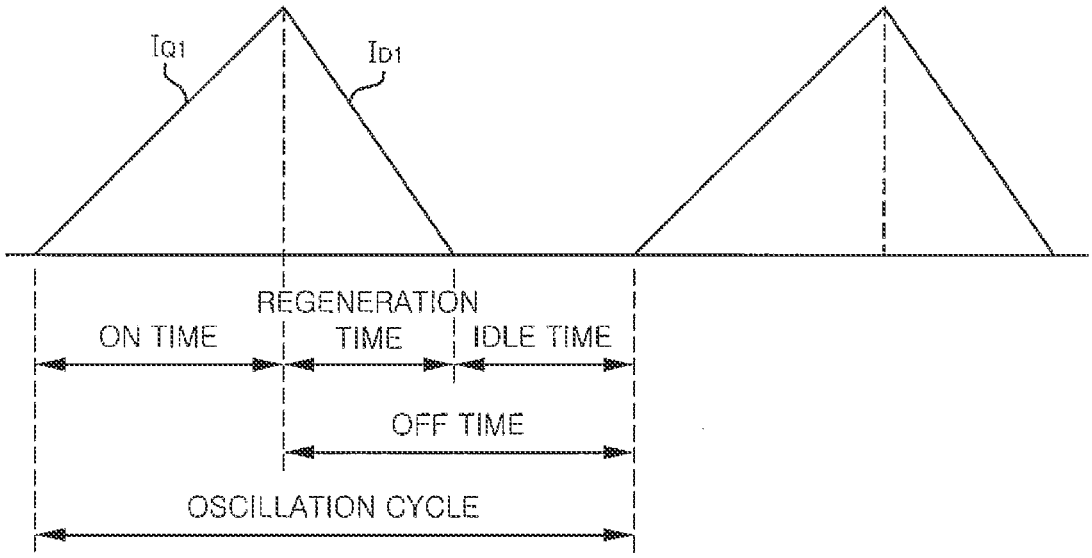
FIG. 5 is a waveform diagram of an operation in accordance with the second embodiment of the present invention.

Accordingly, as shown in FIG. 5, the current flowing through the inductor L1 repeats an oscillation cycle having, as a single set, an ON-time during which the gradually increasing current IQ1 flows→a regeneration time during which the gradually decreasing current ID1 flows→an idle time during which no current flow. An OFF time during which the switching element Q1 is turned off corresponds to regeneration time+idle time of FIG. 5. When the idle time is zero, the critical mode shown in FIGS. 2A to 2C is entered.

Figure 6:
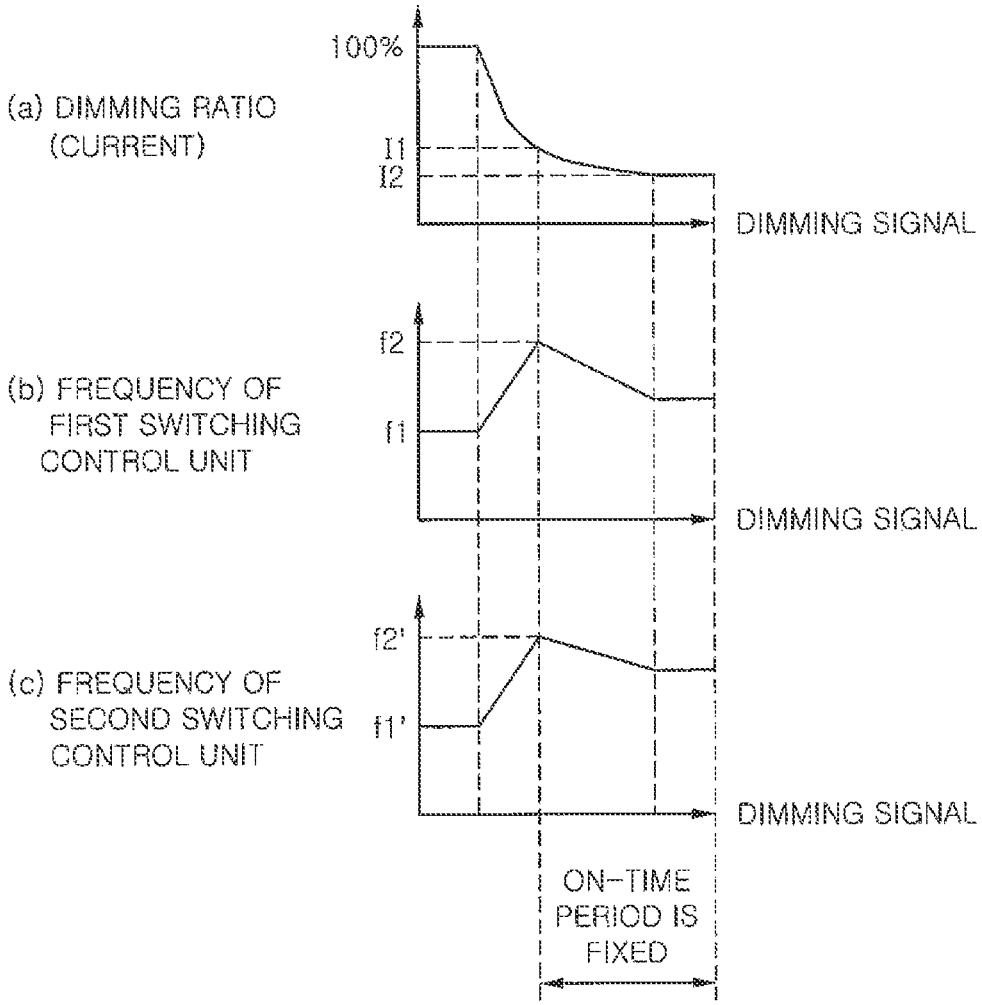
FIG. 6 is a diagram showing the operation in accordance with the second embodiment of the present invention.

FIG. 6 is a diagram showing the operation of the present embodiment. In the present embodiment, when the dimming ratio (current) is equal to or greater than the predetermined value I1, the first switching control is operated in the critical mode (see FIGS. 2A to 2C), whereas when the dimming ratio is less than the predetermined value I1, the first switching control is operated in the discontinuous mode by fixing the ON-time period of the switching element Q1 or by making it almost constant (see FIG. 5).

In order to fix the ON-time period of the switching element Q1, it is preferable to fix a command voltage for ON time setting, which is applied from the dimming control circuit 21 to the ON-time timer 22. Thereafter, as the dimming signal from the dimmer increases, the idle time of the idle time timer 23 gradually increases from zero. Accordingly, since the oscillation cycle, as shown in FIG. 5, is lengthened, the dimming ratio (current) decreases from I1 to I2, as shown in (a) of FIG. 6, and then the frequency of the first switching control is lowered, as shown in (b) of FIG. 6. Due to this, the frequency (i.e., burst ON/OFF frequency) of the second switching control decreases according to the frequency of the first switching control (see (c) of FIG. 6).

Further, with respect to operations performed until the dimming ratio (current) shown in (a) of FIG. 6 decreases from 100% to the predetermined value I1, the first switching control is operated in critical mode (i.e., idle time in FIG. 5 is zero), as described above by referring to FIGS. 2A to 2C. Therefore, as the frequency (high frequency) of the first switching control increases from f1 to f2, the frequency (low frequency) of the second switching control increases from f1' to f2', as shown in (b) and (c) of FIG. 6. Accordingly, switching loss occurring when the dimming ratio (current) is high can be reduced, and thus improving efficiency. Herein, the frequencies of the first and the second switching controls are respectively constant or almost constant when the dimming ratio is 100% or less than I2.

Embodiment 3

Figure 7:
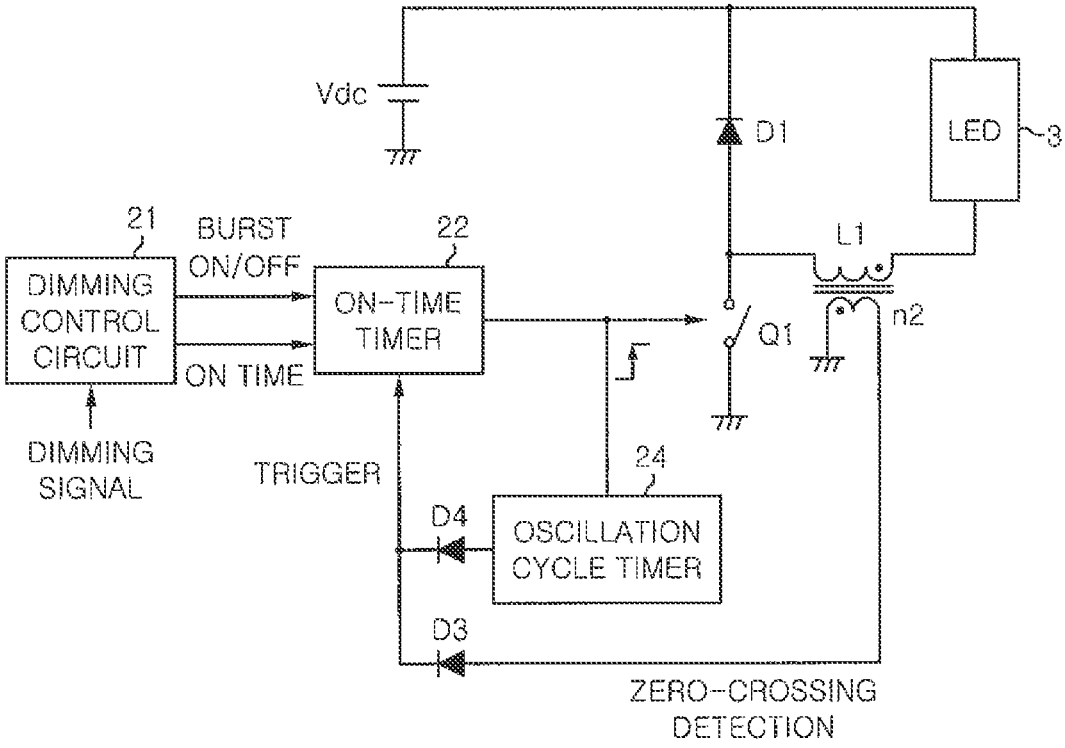
FIG. 7 is a circuit diagram of a lighting device for a solid-state light source in accordance with a third embodiment of the present invention.

FIG. 7 is a circuit diagram of a lighting device for a solids state light source in accordance with a third embodiment of the present invention. The principal configuration of the circuit is identical to that of FIG. 1. In the present embodiment, an oscillation cycle timer 24 instead of the idle time timer 23 in FIG. 4 is provided. The oscillation cycle timer 24 defines the shortest oscillation cycle, i.e., the highest frequency.

As shown in FIG. 7, the oscillation cycle timer 24 monitors the output of an ON-time timer 22, and then it generates a pulse voltage of a predetermined time period when the rising edge of the output from the ON-time timer 22 (i.e., timing at which a switching element Q1 is turned on) is detected. This pulse voltage is inputted to a trigger terminal of the ON-time timer 22 via a diode D4. Further, a flyback voltage outputted from the secondary coil n2 of an inductor L1 is inputted to the trigger terminal via a diode D3. The diodes D3 and D4 form an OR circuit, so that the ON-time timer 22 is triggered at the slower timing between a timing at which the flyback voltage from the secondary coil n2 of the inductor L1 disappears and a timing at which the pulse voltage from the oscillation cycle timer 24 falls.

Figure 8:
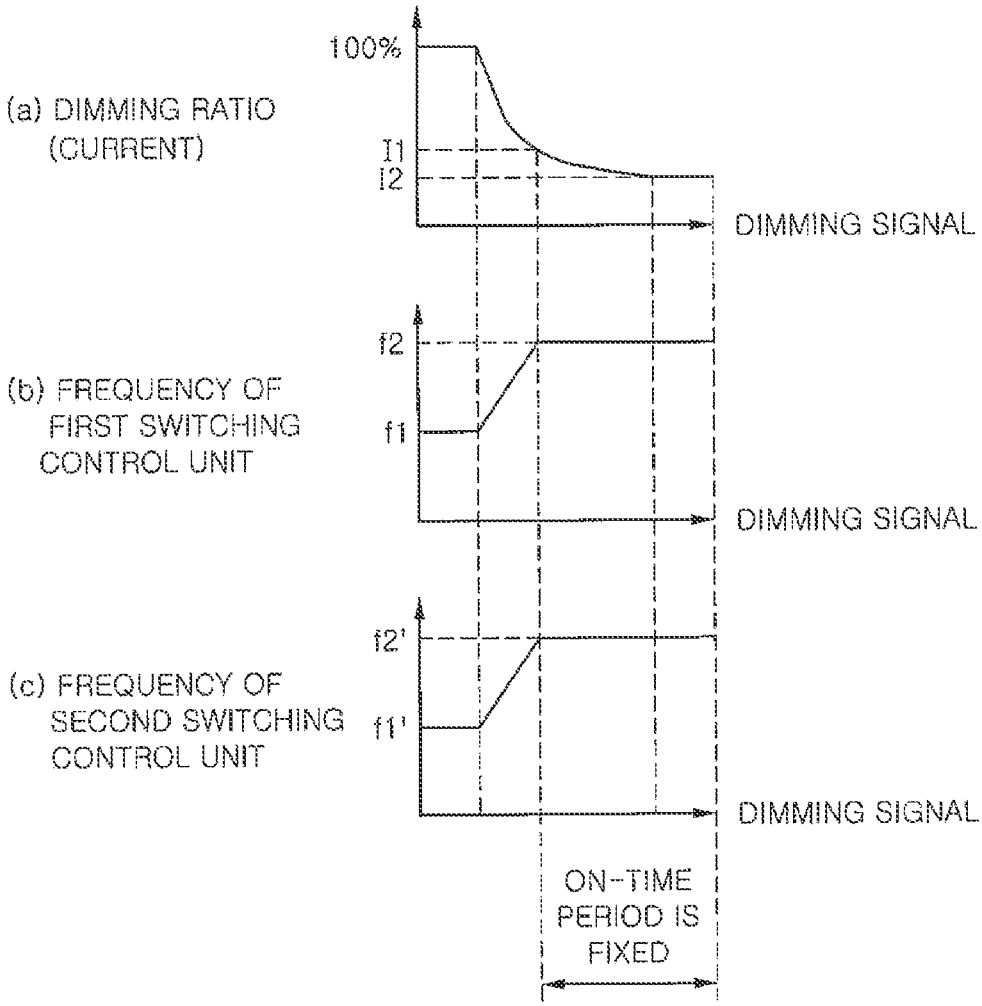
FIG. 8 is a diagram showing the operation in accordance with the third embodiment of the present invention.

FIG. 8 is a diagram showing the operation of the present embodiment. The oscillation cycle timer 24 in FIG. 7 generates a pulse voltage of a time period corresponding to a reciprocal of the highest frequency f2 of the first switching control, as shown in (b) of FIG. 8. Further, the dimming control circuit 21 performs control such that the ON duty of a burst ON/OFF cycle decreases as needed at the same time that the ON time of the ON-time timer 22 is shortened as the dimming signal from the dimmer increases.

With respect to operations performed until the dimming ratio (current) shown in (a) of FIG. 8 decreases from 100% to the predetermined value I1, the first switching control is operated in the critical mode, as described above by referring to FIGS. 2A to 2C. Therefore, as the frequency of the first switching control increases from f1 to f2, the frequency of the second switching control increases from f1' to f2', as shown in (b) and (c) of FIG. 8. Accordingly, switching loss occurring when the dimming ratio (current) is high can be reduced, and thus improving efficiency.

When the dimming ratio shown in (a) of FIG. 8 is less than the predetermined value I1, the timing at which the pulse voltage from the oscillation cycle timer 24 falls becomes slower than the timing at which the flyback voltage from the secondary coil n2 of the inductor L1 disappears. Hence, the oscillation cycle of the switching element Q1 is a fixed value determined by the oscillation cycle timer 24. Accordingly, when the dimming ratio shown in (a) of FIG. 8 is less than the predetermined value I1, the frequency of the first switching control is fixed at the highest frequency f2, as shown in (b) of FIG. 8.

Thereafter, as clearly seen from FIG. 5, as ON time+regeneration time becomes shorter than the shortest oscillation cycle, an idle time occurs, and thus the critical mode is automatically changed into the discontinuous mode. In that case, since the ON time of the switching element Q1 is shortened, the OFF time is lengthened. Thus, as the dimming signal from the dimmer increases, the dimming ratio decreases, as shown in (a) of FIG. 8.

Embodiment 4

Figure 9:
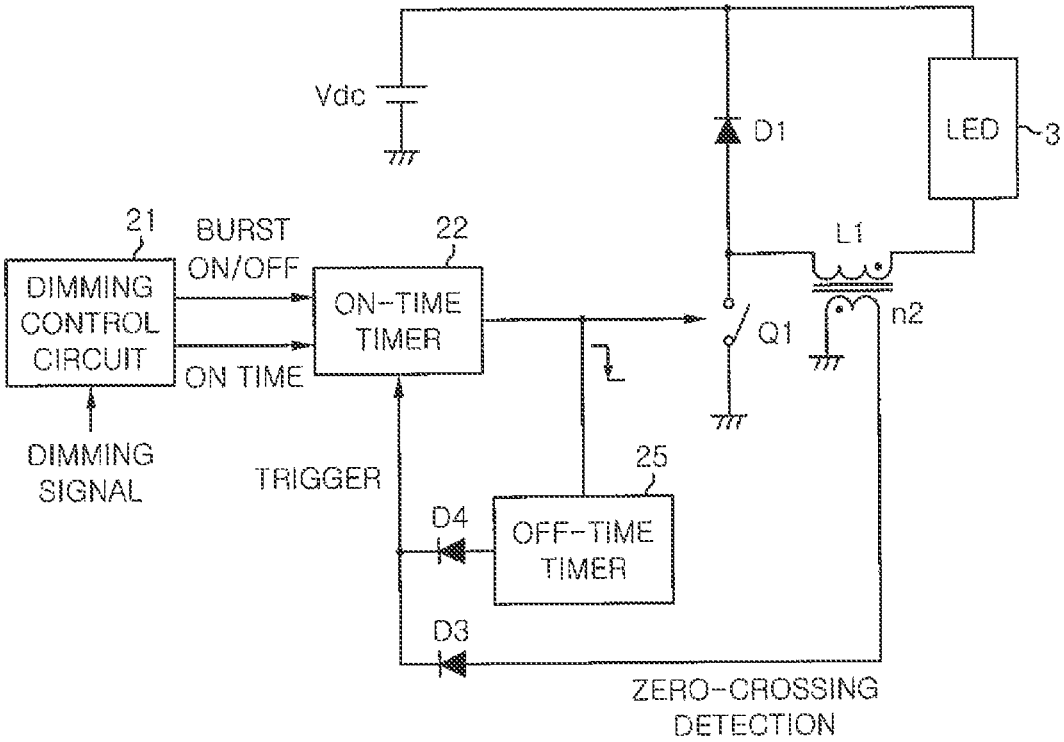
FIG. 9 is a circuit diagram of a lighting device for a solid-state light source in accordance with a fourth embodiment of the present invention.

FIG. 9 is a circuit diagram of a lighting device for a solids state light source in accordance with a fourth embodiment of the present invention. The principal configuration of the circuit is identical to that of FIG. 1. In the present embodiment, an OFF-time timer 25 instead of the idle time timer 23 in FIG. 4 is provided. The OFF-time timer 25 defines the shortest OFF time.

As shown in FIG. 9, the OFF-time timer 25 monitors the output of an ON-time timer 22, and then generates a pulse voltage of a predetermined time period when the falling edge of the output of the ON-time timer 22 (i.e., timing at which a switching element Q1 is turned off) is detected. This pulse voltage is inputted to the trigger terminal of the ON-time timer 22 via a diode D4. Further, a flyback voltage from the secondary coil n2 of an inductor L1 is inputted to the trigger terminal via a diode D3. The diodes D3 and D4 form an OR circuit, so that the ON-time timer 22 is triggered at the slower timing between a timing at which the flyback voltage from the secondary coil n2 of the inductor L1 disappears and the timing at which the pulse voltage from the off-time timer 25 falls.

Figure 10:
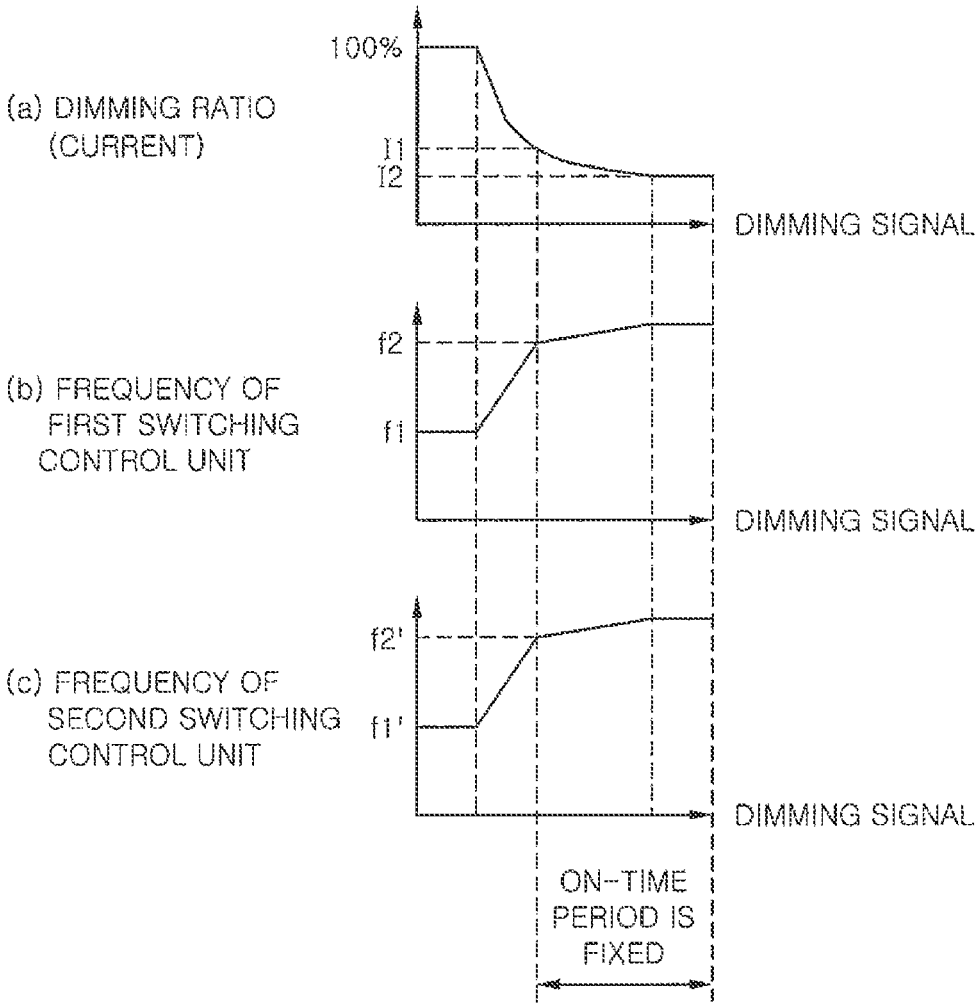
FIG. 10 is a diagram showing the operation in accordance with the fourth embodiment of the present invention.

FIG. 10 is a diagram showing the operation of the present embodiment. The OFF-time timer 25 in FIG. 9 generates a pulse voltage of a time period corresponding to regeneration time (see FIG. 5) when the frequency of the first switching control shown in (b) of FIG. 10 reaches f2. Further, a dimming control circuit 21 controls such that the ON duty of a burst ON/OFF cycle decreases as needed at the same time that the ON time of the ON-time timer 22 is shortened as the dimming signal from the dimmer increases.

Operations, in which the dimming ratio shown in (a) of FIG. 10 decreases from 100% to the predetermined value I1, correspond to the description on FIGS. 2A to 2C. The first switching control is operated in the critical mode, and such that as the frequency of the first switching control increases from f1 to f2, the frequency of the second switching control increases from f1' to f2', as shown in (b) and (c) of FIG. 10. Accordingly, switching loss occurring when the dimming ratio (current) is high can be reduced, and thus improving efficiency.

When the dimming ratio shown in (a) of FIG. 10 becomes less than the predetermined value I1, the timing at which the pulse voltage from the OFF-time timer 25 falls becomes slower than the timing at which the flyback voltage from the secondary coil n2 of the inductor L1 disappears. Hence, the OFF time of the switching element Q1 is a fixed value determined by the OFF-time timer 25.

Accordingly, when the dimming ratio shown in (a) of FIG. 10 is less than the predetermined value I1, the frequency of the first switching control is almost constant (≈f2). However, as clearly seen from FIG. 5, even if the OFF time is constant, the ON time of the switching element Q1 is reduced, so that the oscillation cycle is shortened to that extent. Accordingly, as shown in (a) of FIG. 10, as the dimming signal from the dimmer increases, the frequency of the first switching control gradually increases. Due thereto, the frequency of the second switching control (i.e., the burst ON/OFF frequency) gradually increases according to the frequency of the first switching control (e.g., see (c) of FIG. 10).

Further, when the regeneration time becomes shorter than the shortest OFF time, an idle time occurs, as clearly seen from FIG. 5, and thus the critical mode is automatically changed into the discontinuous mode.

Embodiment 5

Figure 11:
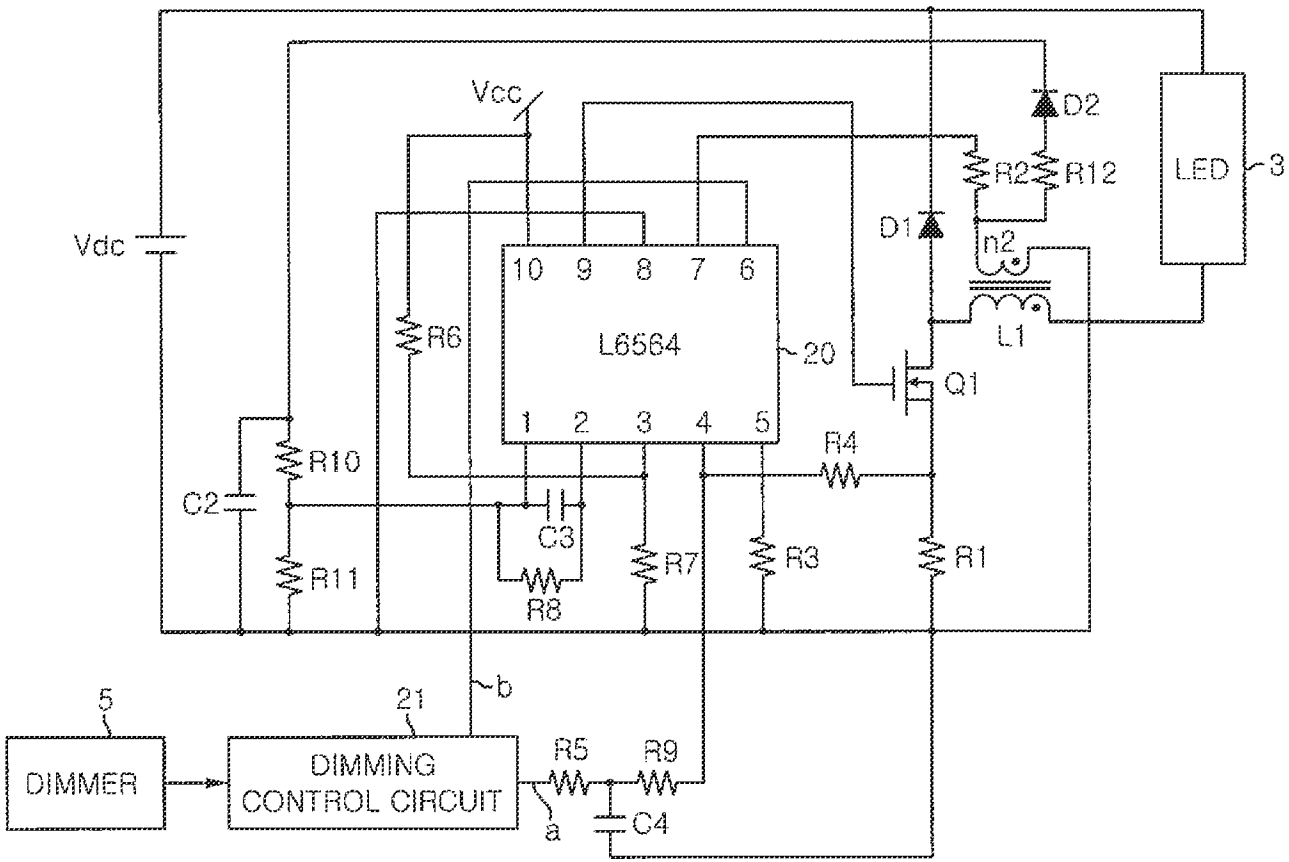
FIG. 11 is a circuit diagram of a lighting device for a solid-state light source in accordance with a fifth embodiment of the present invention.

FIG. 11 is a circuit diagram of a lighting device for a solids state light source in accordance with a fifth embodiment of the present invention. In the present embodiment, a general-purpose IC 20 for improving energy efficiency is used to perform an operation of controlling the peak value of current flowing through a switching element Q1 to predetermined threshold values Ip1 to Ip3, as shown in FIGS. 2A to 2C and to realize the above-described control in the critical mode.

As this type of IC for power factor correction, L6562, which is manufactured by STMicroelectronics (STME), is conventionally well known. However, in the present embodiment, L6564 manufactured by STME is employed as the IC capable of selecting whether to perform Power Factor Correction (PFC) in response to an external signal so that the burst ON periods t1 to t3 of the switching element Q1 can be set in response to the external signal, as shown in FIGS. 2A to C.

L6564 is an IC in which a PFC-OK terminal (pin 6) and a VFF terminal (pin 5) are added to the existing 8-pin L6562, and the arrangement of the remaining pins corresponds to that of the pins of L6562.

Hereinafter, the circuit configuration of FIG. 11 is described while the functions of individual terminals of L6564 are described briefly.

Pin 10 is a power terminal and is connected to a control supply voltage Vcc. Pin 8 is a ground terminal and is connected to the cathode (circuit ground) of the input DC power source Vdc.

Pin 9 is a gate drive terminal and is connected to the gate electrode of the switching element Q1 implemented as a MOSFET (Metal Oxide Semiconductor Field Effect Transistor).

Pin 7 is a zero-crossing detection terminal, and is connected to one end of the secondary coil n2 of the inductor L1 via a resistor R2. The other end of the secondary coil n2 is grounded.

Pin 6 is a PFC-OK terminal added compared to L6562. When the voltage of this pin falls below 0.23 V, the IC is shut down. In order to restart the IC, this pin 6 must be set to a value higher than 0.27 V. Accordingly, pin 6 may be used as remote ON/OFF control input.

Pin 5 is a feed-forward terminal, and this is not used in the present embodiment and is then connected to the circuit ground via a resistor R3.

Pin 4 is a current detection terminal and receives a voltage of a current detection resistor R1, disposed between the source electrode of the switching element Q1 implemented as a MOSFET and the circuit ground, via a resistor R4. Further, this terminal receives a bias voltage for dimming via a resistor R9.

Pin 3 is an input of a multiplier included in the IC and is set as a predetermined voltage obtained by dividing the control supply voltage Vcc by resistors R6 and R7.

Pin 1 is an inverting input terminal of an error amplifier included in the IC and pin 2 is the output terminal of the error amplifier. As a feedback impedance of the error amplifier, a parallel circuit of a resistor R8 and a capacitor C3 is connected between pins 1 and 2. Further, a negative feedback voltage signal obtained by dividing a voltage of a capacitor C2 by resistors R10 and R11 is inputted to pin 1. A voltage induced in the secondary coil n2 of the inductor L1 is charged in the capacitor C2 via a resistor R12 and a diode D2. When the voltage of the capacitor C2 increases, a period of an ON pulse at the switching element Q1 is controlled to be narrowed.

In the case where the switching element Q1 is in an ON state, if a current flowing through the current detection resistor R1 increases, a voltage detected at pin 4 increases. When the voltage at pin 4 reaches a predetermined threshold value, the switching element Q1 is turned off. Thereafter, during a period in which the energy of the inductor L1 is discharged via the diode D1, a voltage is induced in the secondary coil n2 of the inductor L1. When a regenerative current passing through the diode D1 has completely flowed, the voltage induced in the secondary coil n2 disappears, and the voltage at pin 7 falls. When the falling of the voltage at pin 7 is detected, the switching element Q1 is turned on again.

The DC voltage of the capacitor C4 overlaps pin 4 via the resistor R9. The capacitor C4 is charged or discharged by the output signal of the dimming control circuit 21 via the resistor R5. The output signal of the dimming control circuit 21 is, e.g., a square wave voltage signal, and the DC voltage charged in the capacitor C4 varies according to a ratio of high level and low level periods of the square wave voltage signal. That is, the capacitor C4 and the resistor R5 form a CR filter circuit (i.e., an integral circuit).

When the DC voltage charged in the capacitor C4 is high, the voltage of pin 4 becomes high, and thus the current flowing through the switching element Q1 is seemingly detected as being increased. Therefore, the peak value of the current flowing through the switching element Q1 is decreased, as shown in FIG. 2C.

When the DC voltage charged in the capacitor C4 is low, the voltage of pin 4 becomes low, and thus the current flowing through the switching element Q1 is seemingly detected as being decreased. Accordingly, the peak value of the current flowing through the switching element Q1 is increased, as shown in FIG. 2A.

In this way, the magnitude of the DC voltage charged in the capacitor C4 is adjusted according to the ratio of the high level and low level periods (ON/OFF duty) of the square wave voltage signal outputted from the dimming control circuit 21, thus enabling the peak value of the current flowing through the switching element Q1 to be adjusted.

The dimming control circuit 21 may be implemented as, e.g., a microcomputer for dimming. In that case, it is preferable to assign a single 2-value output port for outputting a square wave voltage signal to an output terminal a.

Further, when the microcomputer has a D/A conversion output port as the output terminal instead of the 2-value output port, it is also possible to omit a CR filter circuit having the resistor R5 and the capacitor C4. Even in that case, when the CR filter circuit is not omitted, an analog output voltage from the D/A conversion output port is inputted to the CR filter circuit and DC voltages adjacent by one gray level are switched at a predetermined duty, DC voltages corresponding to multiple gray levels more than original gray levels of D/A conversion can be generated. Further, compared to the case where the 2-value output port is used, the ripple component of the DC voltage charged in the capacitor C4 can be reduced even if a time constant of the resistor R5 and the capacitor C4 is small, thus enabling the responsiveness to control to be enhanced.

Next, another 2-value output port of the microcomputer may be assigned to an output terminal b for designating the burst ON periods t1 to t3 shown in FIGS. 2A to 2C. A square wave voltage signal may be outputted which becomes a high level (higher than 0.27 V) during a burst ON period and becomes a low level (lower than 0.23 V) during the remaining periods.

The duty (%) of the dimming signal, inputted from the dimmer 5 to the dimming control circuit 21, changes within the range from 0% to 100%, and the dimming signal indicates a fully turned-on state at a duty of 5% or less, and indicates a turned-off state at a duty of 95% or more. Such a dimming signal has been widely propagated in the field of inverter-type fluorescent lamp lighting devices. Generally, a square wave voltage signal having a frequency of 1 kHz and amplitude of 10 V is used as the dimming signal.

The dimming control circuit 21 reads the duty (%) of the dimming signal outputted from the dimmer 5, and changes the duty of a square wave voltage signal outputted from the first output terminal a and the duty of a square wave voltage signal outputted from the second output terminal b, according to the read duty. When the dimming control circuit 21 is configured as the microcomputer, it is preferable to read a data table by using a digital value, obtained by reading the duty (%) of the dimming signal outputted from the dimmer 5, as an address, and to control the duties of the square wave voltage signals outputted from the terminals a and b of the dimming control circuit 21 on the basis of the read data from the data table.

In this regard, although the case where a square wave voltage signal having a frequency of 1 kHz and an amplitude of 10 V is used as the dimming signal outputted from the dimmer 5 has been assumed and described, the dimming signal is not limited thereto. For example, various types of standardized dimming signals, such as DALI or DMX512, may be used. Alternatively, a PWM (Pulse Width Modulation) signal of 100/120 Hz may be extracted as the dimming signal from a power line by shaping the waveform of a phase-controlled voltage of commercial AC power (50/60 Hz). Alternatively, the dimmer 5 may be a simple variable resistor and may be configured such that a dimming signal of a DC voltage is read from the A/D conversion input port of the dimming control circuit 21.

Although, in the present embodiment, an example in which a low-frequency PWM control is achieved by the microcomputer of the dimming control circuit 21 has been described, it is also possible to achieve a low-frequency PWM control using a general-purpose timer circuit as in a sixth embodiment which will be described below. Further, it is also possible to achieve a low-frequency PWM control by using a general-purpose PWM control IC as in a seventh embodiment which will be described later.

Embodiment 6

Figure 12:
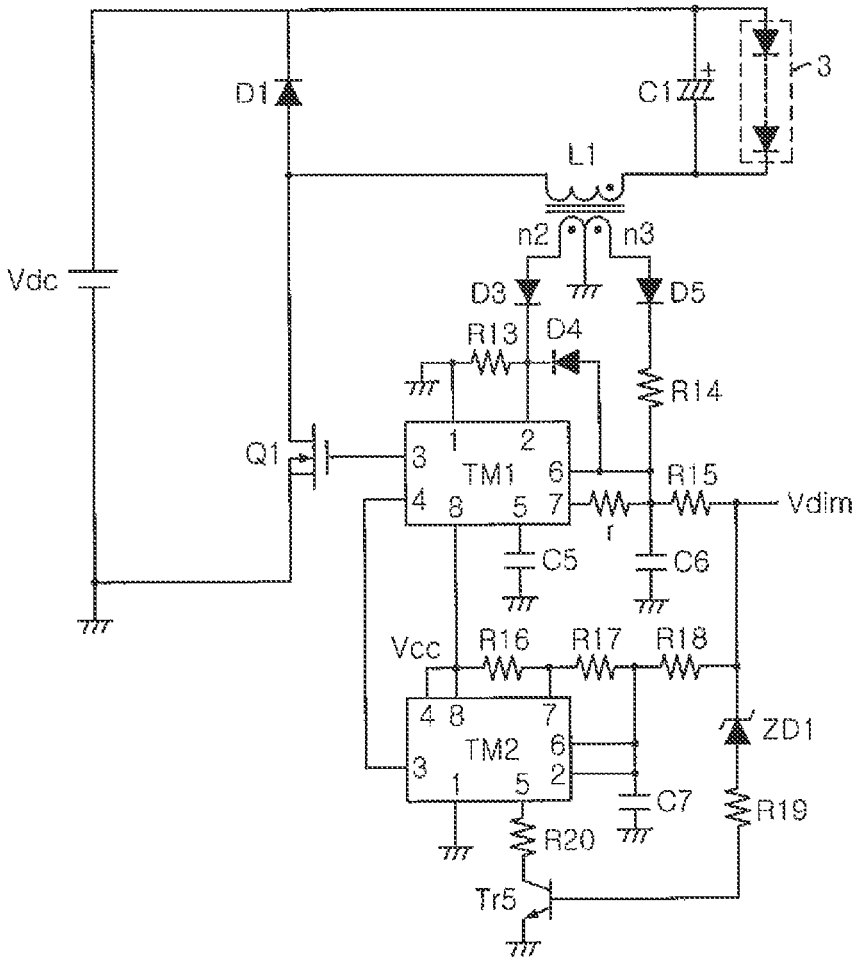
FIG. 12 is a circuit diagram of a lighting device for a solid-state light source in accordance with a sixth embodiment of the present invention.

FIG. 12 is a circuit diagram presenting a lighting device for a solids state light source in accordance with the sixth embodiment of the present invention. In the present embodiment, the first and second switching controls are implemented by using general-purpose timer circuits TM1 and TM2 and peripheral circuits thereof.

Figure 13:
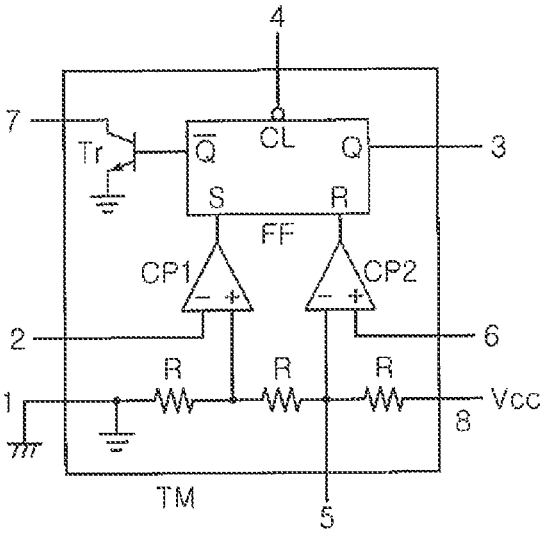
FIG. 13 is a circuit diagram showing the internal configuration of a timer circuit applied in the sixth embodiment or a seventh embodiment of the present invention.

The timer circuits TM1 and TM2 are well-known timer ICs (what is called 555), each having an internal configuration of a circuit diagram shown in FIG. 13, and may be configured with, e.g., μPD5555 or dual version thereof (μPD5556) of Renesas Electronics Corporation (formerly NEC Electronics), or substitutions therefor. Pin 1 of the timer circuits TM1 and TM2 is a ground terminal and pin 8 thereof is a power terminal.

Pin 2 is a trigger terminal and is configured such that when this terminal is lower than half of the voltage of pin 5 (typically, ⅓ of supply voltage Vcc), an internal flip-flop FF is set by an output of a first comparator CP1, and thus, pin 3 (output terminal) goes to a high level and pin 7 (discharge terminal) goes to an open state.

Pin 4 is a reset terminal and is configured such that when this terminal goes to a low level, the first timer TM1 enters to an operation stop state, and pin 3 (output terminal) is fixed at a low level. The second timer circuit TM2 can always be operated because pin 4 is fixed at the high level. Since pin 4 of the first timer circuit TM1 is connected to pin 3 (output terminal) of the second timer circuit TM2, the first timer circuit TM1 is permitted to be operated when pin 4 thereof is at a high level and is prohibited from being operated when pin 4 is at a low level.

Pin 5 is a control terminal and is supplied with a reference voltage, which is typically ⅔ of the supply voltage Vcc), via internal bleeder resistors (a series circuit of three resistors R) shown in FIG. 13. In the first timer circuit TM1, a reference voltage at pin 5 is stabilized by a capacitor C5. In the second timer circuit TM2, the reference voltage at pin 5 is controllable so that it falls below ⅔ of the supply voltage Vcc by a transistor Tr5.

Pin 6 is a threshold terminal and is configured such that when this terminal becomes higher than the voltage at pin 5 (typically, ⅔ of the supply voltage Vcc), an internal flip-flop FF is reset by the output of a second comparator CP2, and then pin 3 (output terminal) goes to a low level and pin 7 (discharge terminal) is shorted to pin 1 by an internal transistor Tr.

The first timer circuit TM1 implements a first switching control for controlling ON/OFF operations of the switching element Q1 at a high frequency. The ON time of the switching element Q1 is defined by an ON-time timer having a resistor R14 and a capacitor C6 and may be variable depending on a dimming voltage Vdim overlapping via a resistor R15. Further, the OFF time of the switching element Q1 is defined as the time taken for a flyback voltage outputted from the secondary coil n2 of the inductor L1 to disappear. Further, a minimum value for the OFF time of the switching element Q1 may be limited by an OFF-time timer having a resistor r and the capacitor C6.

First, the ON-time timer of the switching element Q1 will be described. In the present embodiment, the current detection resistor R1 in FIG. 11 is omitted and, instead, a tertiary coil n3 is provided in the inductor L1. Since an output voltage at the forward end of the tertiary coil n3 is time-integrated, a current equivalently flowing through the switching element Q1 is detected as a voltage at the capacitor C6.

Hereinafter, the principle thereof will be described. If it is assumed that when the switching element Q1 is in an ON state, a voltage applied to the inductor L1 is e1 and a current flowing through the switching element Q1 is i, $e1=L1\cdot(di/dt)$ is satisfied. In this case, the voltage generated in the tertiary coil n3 becomes $e3=(n3/n1)e1$ on the assumption that the number of turns in the primary coil of the inductor L1 is n1. If the voltage is integrated with respect to time t, $\int(e3)dt=(n3/n1)L1\cdot i+C$ is obtained. Herein, C is an integral integer, and, in critical mode shown in FIGS. 2A to 2C or discontinuous mode of FIG. 5, the initial value of current i flowing through the switching element Q1 is zero, and thus the integral integer C=0 is obtained. Therefore, when the forward end voltage generated in the tertiary coil n3 is time-integrated, the current i flowing through the switching element Q1 can be read.

The time integral may be accurately obtained by using a mirror integrator, but it is performed here by a CR integral circuit having the resistor R14 and the capacitor C6 for the purpose of simplification. A diode D5 is provided to integrate only the forward end voltage generated in the tertiary coil n3.

When the switching element Q1 is turned on, a gradually increasing current flows along a path of the anode of the DC power source Vdc→a capacitor C1→the inductor L1→the switching element Q1→the cathode of the DC power source Vdc. In this case, a voltage e3 proportional to the voltage applied to the inductor L1 is generated in the tertiary coil n3. The capacitor C6 is charged with the voltage e3 via the diode D5 and the resistor R14. In this case, since pin 7 of the timer circuit TM1 is in an open state, discharging does not occur via the resistor r having low resistance. Further, a current flowing through the resistor R13 having high resistance via the diode D4 is not at such a level to interfere with the rising of the voltage of the capacitor C6.

The rising of the voltage of the capacitor C6 is detected by pin 6 of the timer circuit TM1, so that when the detected voltage is higher than the reference voltage at pin 5 (⅔ of the supply voltage Vcc), pin 3 goes to a low level, and the switching element Q1 is turned off. In this case, since the transistor Tr on pin 7 is turned on, the capacitor C6 is discharged via the low-resistance resistor r, and the time-integrated value of the capacitor C6 is reset.

Since the voltage of the capacitor C6 is discharged via the low-resistance resistor r, it falls relatively rapidly. The voltage of pin 2 is a voltage obtained by subtracting the forward voltage of the diode D4 from the voltage of pin 6. Before the voltage of pin 2 falls to ⅓ of the supply voltage Vcc, the flyback voltage of the secondary coil n2 of the inductor L1 rises. The voltage of pin 2 is maintained at a level higher than ⅓ of the supply voltage Vcc during the generation of the flyback voltage.

When the regenerative current of the inductor L1 has completely flowed, the flyback voltage of the secondary coil n2 disappears. Thereafter, a potential at pin 2 is falls to the level of the circuit ground via the resistor R13. Accordingly, the output of the first comparator CP1 on pin 2 is inverted and the flip-flop FF is set, so that pin 3 goes to a high level and the switching element Q1 is turned on. Further, since the transistor Tr on pin 7 is turned off, the capacitor C6, which was shorted to the circuit ground via the low-resistance resistor r, is charged with the forward voltage from the tertiary coil n3 via the diode D5 and the resistor R14. When the voltage of the capacitor C6 reaches the voltage of pin 5, the flip-flop FF is reset by the second comparator CP2 on pin 6, and then pin 3 goes to a low level. As a result, the switching element Q1 is turned off. Further, since the transistor Tr on pin 7 is turned on, the capacitor C6 is discharged almost instantaneously via the low-resistance resistor r.

Next, the same operations are repeated, and a high-frequency pulse of several tens of kHz is repeatedly outputted from pin 3 (output terminal) of the first timer circuit TM1. The ON time of the high-frequency pulse is determined according to the time taken for the current flowing through the switching element Q1 to reach a predetermined peak value. The OFF time of the high-frequency pulse is determined according to the time taken for the regenerative current of the inductor L1 to completely flow. Therefore, the current flowing through the inductor L1 experiences a zero-crossing operation (in critical mode), as shown in FIGS. 2A to 2C.

A dimming voltage Vdim overlaps the capacitor C6 forming the ON-time timer together with the resistor R14, through a resistor R15. When the dimming voltage Vdim is higher, the charging speed of the capacitor C6 becomes faster, and thus, the ON time of the switching element Q1 is shortened. When the dimming voltage Vdim is lower, the charging speed of the capacitor C6 becomes slower, and thus, the ON time of the switching element Q1 is lengthened. Accordingly, as the dimming voltage Vdim increases, the peak value of the current flowing through the inductor L1 is reduced in the form of peak Ip1 of FIG. 2A→peak Ip2 of FIG. 2B→peak Ip3 of FIG. 2C. When the dimming voltage Vdim is constant, the period of the ON time is determined according to the forward voltage fed back from the tertiary coil n3 of the inductor L1.

The second timer circuit TM2 implements a second switching control for intermittently stopping the high-frequency ON/OFF operations of the switching element Q1 at a low frequency.

The second timer circuit TM2 functions as an astable multivibrator in such a way that resistors R16 and R17 and a capacitor C7 for time constant setting are attached to the outside of the circuit TM2. The voltage of the capacitor C7 is inputted to pin 2 (trigger terminal) and to pin 6 (threshold terminal) and is then compared with an internal reference voltage.

In the early stage of the supply of power, the voltage of the capacitor C7 is lower than the reference voltage (½ of the voltage of pin 5), which is compared with the voltage of pin 2 (trigger terminal), so that pin 3 (output terminal) goes to a high level and pin 7 (discharge terminal) goes to an open state. Accordingly, the capacitor C7 is charged with the supply voltage Vcc via the resistors R16 and R17.

When the voltage of the capacitor C7 becomes higher than the reference voltage (the voltage of pin 5), which is compared with the voltage of pin 6 (threshold terminal), pin 3 (output terminal) goes to a low level, and pin 7 (discharge terminal) is shorted to pin 1. Accordingly, the capacitor C7 is discharged via the resistor R17.

When the voltage of the capacitor C7 becomes lower than the reference voltage (½ of the voltage of pin 5), which is compared with the voltage of pin 2 (trigger terminal), pin 3 (output terminal) goes to a high level and pin 7 (discharge terminal) goes to an open state. Accordingly, the capacitor C7 is charged again with the supply voltage Vcc via the resistors R16 and R17. Then, the same operations are repeated.

A time constant of the resistors R16 and R17 and the capacitor C7 is set such that the oscillation frequency of pin 3 (output terminal) is, e.g., a low frequency of about 1 kHz. Further, the dimming voltage Vdim overlaps a connection node of the resistor R17 and the capacitor C7 via a resistor R18.

When the dimming voltage Vdim is higher, the charging speed of the capacitor C7 becomes faster, but the discharging speed of the capacitor C7 becomes slower, so that a period in which pin 3 is at a high level is shortened, and a period in which pin 3 is at a low level is lengthened. In contrast, when the dimming voltage Vdim is lower, the charging speed of the capacitor C7 becomes slower, but the discharging speed of the capacitor C7 becomes faster, so that the period in which pin 3 is at a high level is lengthened, and the period in which pin 3 is at a low level is shortened. Accordingly, as the dimming voltage Vdim becomes higher, the ON duty (the ratio of a burst ON period in one burst-ON cycle) of the low-frequency PWM control is reduced.

Further, when the dimming voltage Vdim becomes higher than the sum of the zener voltage of a zener diode ZD1 and the base-emitter voltage of the transistor Tr5, the transistor Tr5 acts so that the voltage of pin 5 decreases. As the dimming voltage Vdim becomes higher, the voltage of pin 5 gradually decreases, and thus the oscillation frequency of the timer circuit TM2 increases. In this way, as dimming is down, the cycle of the low-frequency PWM control decreases in the form of cycle T1 of FIG. 2A→cycle T2 of FIG. 2B→cycle T3 of FIG. 2C.

Through the above operations, as the dimming voltage Vdim increases, the duty of burst ON decreases in the form of t1/T1 of FIG. 2A→t2/T2 of FIG. 2B→t3/T3 of FIG. 2C and the peak current is controlled. Thus, dimming in a wide range is possible.

Further, in the circuit diagram in FIG. 12, the capacitor C1 (capacitive impedance) is connected in parallel to the solid-state light source 3 and the frequency of the second switching control is set such that the current flowing through the solid-state light source 3 forms a continuous waveform. Herein, said forming continuous waveform includes a case in which a current variation rate defined by (maximum current−minimum current)÷average current is equal to or less than a specific value (e.g., equal to or less than 1).

Further, as shown in FIG. 2C, when the peak current Ip3 is low, the burst-ON cycle T3 decreases. Accordingly, an idle period (T3−t3) for the current of the inductor L1 decreases. Therefore, even if the capacity of the smoothing capacitor C1 is small, the ripple component of the current flowing through the solid-state light source 3 can be reduced, and flickering is hardly visible.

For example, when the peak current Ip1 is high, as shown in FIG. 2A, the burst ON cycle T1 is made longer, so that the number of high-frequency pulses included in one cycle can be increased, and the resolution of dimming can be improved.

In the present embodiment, compared to the circuit of FIG. 11, the current detection resistor R1 is omitted, and thus there is an advantage in that the loss of power can be reduced. Further, even if a variation in power or a variation in load has occurred, a voltage applied to the inductor L1 varies when the switching element Q1 is turned on, so that the voltage e3 of the tertiary coil n3 also varies, and such a power or load variation can be detected as a change in the rising speed of the voltage of the capacitor C6, thus enabling the function of the current detection resistor R1 to be substantially replaced.

Embodiment 7

Figure 14:
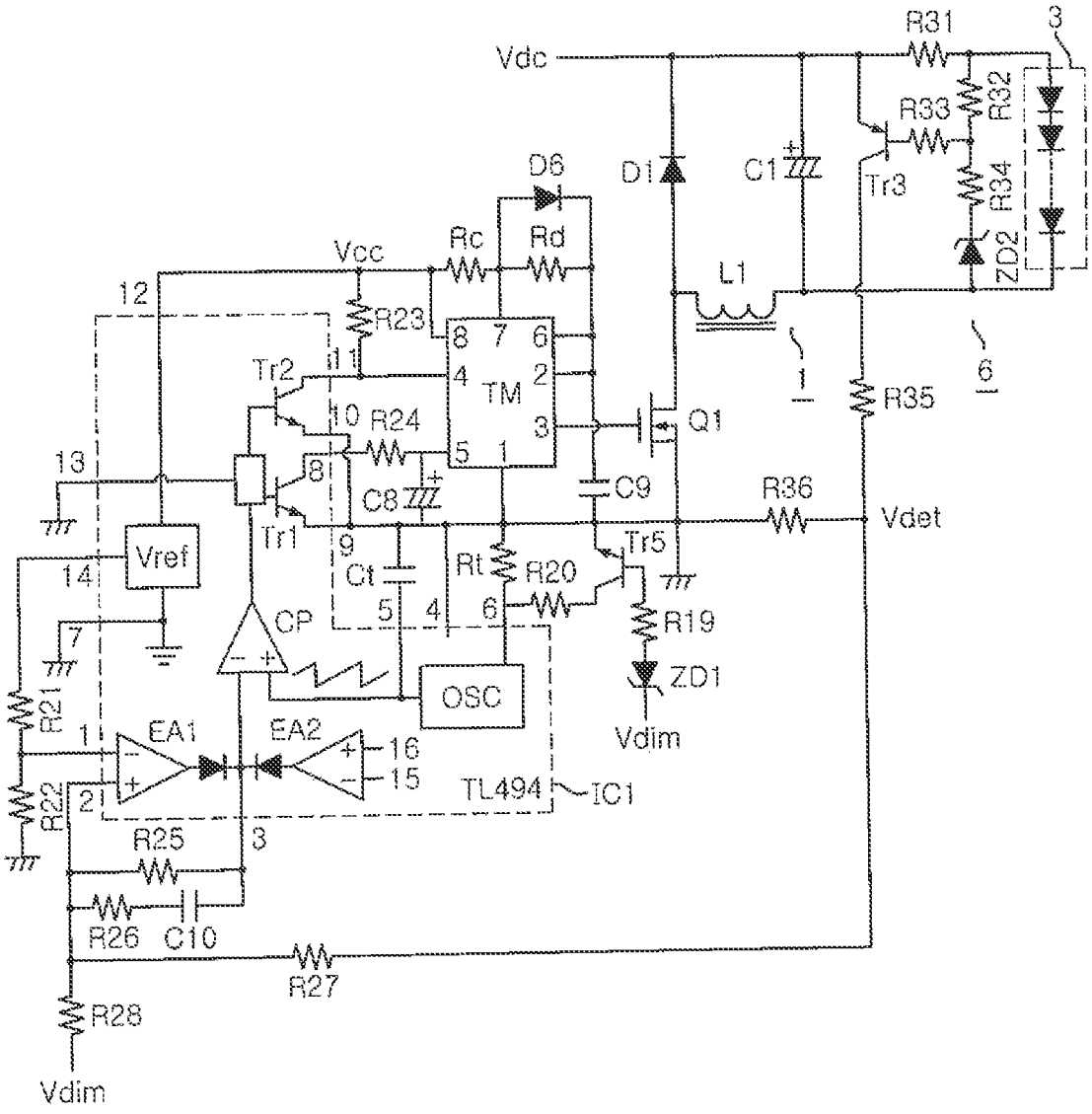
FIG. 14 is a circuit diagram of a lighting device for a solid-state light source in accordance with the seventh embodiment of the present invention.

FIG. 14 is a circuit diagram showing a lighting device for a solids state light source in accordance with a seventh embodiment of the present invention. In the present embodiment, a high-frequency oscillation circuit for turning on/off a switching element Q1 at a high frequency is implemented by using a general-purpose timer circuit TM. Further, a control for intermittently stopping a high-frequency oscillating operation at a low frequency and a control for an ON-time period and an OFF-time period at a high frequency are performed by a PWM control circuit IC1. The PWM control circuit IC1 sets pin 4 of the timer circuit TM to a high level when permitting the operation of the timer circuit TM.

As the timer circuit TM, a general-purpose timer IC (555) shown in FIG. 13 can be used. The timer circuit TM acts as an astable multivibrator and is configured such that when a voltage at pin 2 becomes lower than half of a voltage at pin 5, an internal flip-flop is inverted, pin 3 becomes to a high level, and pin 7 becomes to an open state, and thus a capacitor C9 is charged via a charging resistor Rc and a diode D6. When the charging voltage of the capacitor C9 applied to pin 6 becomes higher than the voltage at pin 5, the internal flip-flop is inverted, pin 3 (output terminal) becomes to a low level, and pin 7 (discharge terminal) is shorted to pin 1.

Accordingly, the capacitor C9 is discharged via a discharging resistor Rd, and the charging voltage of the capacitor C9 falls. Thereafter, when the charging voltage of the capacitor C9 applied to pin 2 becomes lower than half of the voltage at pin 5, the internal flip-flop is inverted, pin 3 becomes to a high level, and pin 7 becomes to an open state, and thus the capacitor C9 is charged via the charging resistor Rc and the diode D6. Then, the same operations are repeated.

In this way, the timer circuit TM functions as a typical astable multivibrator. The ON-time period of the switching element Q1 is a variable period determined by a time constant of the charging resistor Rc and the capacitor C9 and the voltage at pin 5. Further, the OFF-time period of the switching element Q1 is a variable period determined by a time constant of the discharging resistor Rd and the capacitor C9 and the voltage at pin 5.

Therefore, the switching element Q1 is driven in the ON-time period and the OFF-time period based on the voltage of pin 5 of the timer circuit TM. When the voltage of pin 5 decreases, the range of a variation in the voltage of the capacitor C9 for oscillation decreases, so that the ON-time period and the OFF-time period decrease together. Since, however, a charging current passing through the resistor Rc increases, whereas a discharging current passing through the resistor Rd decreases, the reduction rate of the ON-time period is greater than that of the OFF-time period.

This is suitable for the driving of a light emitting diode having an almost constant load voltage. When the ratio of an ON-time period and an OFF-time period is set in such a way that when the voltage of pin 5 is maximized, a current flowing through an inductor L1 enters discontinuous mode approximate to critical mode, as shown in (a) of FIG. 15, the current can always be operated in discontinuous mode even if the voltage of pin 5 changes. In detail, it is preferable to set the values of the resistors Rc and Rd and the capacitor C9 so that the ON-time period is slightly reduced than that in a critical condition satisfying [ON-time period×(supply voltage−load voltage)≈OFF-time period×load voltage].

Figure 15:
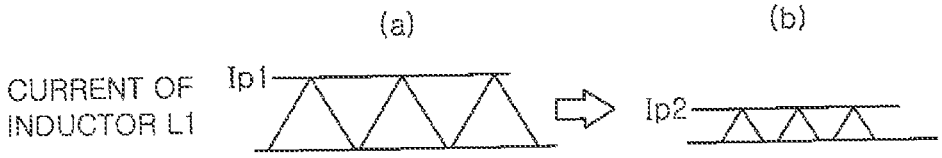
FIG. 15 shows a waveform diagram of the operation in accordance with the seventh embodiment of the present invention.

By the setting made in this way, when the voltage of pin 5 decreases, both the ON-time period and the OFF-time period of the switching element Q1 are shortened, as shown in (b) of FIG. 15, the reduction rate of the ON-time period is greater than that of the OFF-time period, and thus an idle period for the current flowing through the inductor L1 gradually increases.

Therefore, the current idle time can be made longer while the peak of the current flowing through the inductor L1 is reduced, as shown in (b) of FIG. 15, by decreasing the voltage at pin 5 of the timer circuit TM by using the PWM control circuit IC1, thus enabling average current flowing through the inductor L1 during the burst-ON period to be reduced.

In combination with this control, pin 4 of the timer circuit TM is switched to high/low levels at a low frequency (e.g., 1 kHz) by using the PWM control circuit IC1, and thus, a burst-ON period is varied. Accordingly, controls for a state, in which a high average current flows for a long period of time, and a state, in which low average current flows for a short period of time can be executed, and thus, reliable dimming can be achieved in a wide range.

As the PWM control circuit IC1, e.g., TL494 of Texas Instruments or equivalents thereof may be used. This IC includes a sawtooth wave oscillator OSC, a comparator CP, error amps (amplifiers) EA1 and EA2, output transistors Tr1 and Tr2, a reference voltage source and the like. Hence, the IC oscillates at a frequency determined by a capacitor Ct and a resistor Rt externally attached to pins 5 and 6 thereof, respectively and generates a PWM signal at a pulse width based on the voltage of pin 3. An oscillation frequency may also be a low frequency of, e.g., 1 kHz. Pin 4 is a terminal for setting a dead time and is connected to ground in the present embodiment.

A series circuit of a resistor R20 and a transistor Tr5 that are characterized in the present embodiment is connected in parallel to the externally attached resistor Rt that defines the oscillation frequency of the PWM control circuit IC1. When a dimming voltage Vdim becomes higher than the sum of the zener voltage of a zener diode ZD1 and the base-emitter voltage of the transistor Tr5, a current flows through the transistor Tr5, which is substantially a same operation as reduction in the resistance of the resistor Rt. Accordingly, the oscillation frequency of the PWM control circuit IC1 increases as the dimming voltage Vdim rises.

When the zener diode ZD1 is omitted, the frequency of the low-frequency PWM control can be varied in the entire range of the dimming voltage Vdim. On the other hand, when the zener diode ZD1 is installed, a control is performed such that if the current flowing through the solid-state light source 3 is equal to or greater than a predetermined value, the frequency of the low-frequency PWM control is kept constant, and such that when the current flowing through the solid-state light source 3 is less than the predetermined value, the frequency of the low-frequency PWM control increases as the frequency of the high-frequency PWM control increases.

The error AMP EA1 connected to pins 1 and 2 and the error AMP EA2 connected to pins 15 and 16 are diode- or connected, and the output of an error AMP having higher output between the error AMPs EA1 and EA2 is the reference voltage of the comparator CP. In the present embodiment, since the second error AMP EA2 is not used, the potentials of pins 15 and 16 are set so that the output of the error AMP EA2 is the lowest potential.

Pin 13 is a terminal for selecting a single-end operation and a push-pull operation and is connected to the ground in the present embodiment to select the single-end operation. In this case, the operations of transistors Tr1 and Tr2 are made same by an internal logic circuit.

When the transistor Tr2 connected to pins 11-10 is in an ON state, pin 4 of the timer circuit TM becomes to a low level, so that the high-frequency oscillating operation of the timer circuit TM is stopped, and the switching element Q1 is maintained in an OFF state. Further, when the transistor Tr2 is turned off, pin 4 of the timer circuit TM rises to the potential of the control supply voltage Vcc by a resistor R23, and then the high-frequency oscillating operation of the timer circuit TM is initiated.

When the transistor Tr1 connected to pins 8-9 is in an ON state, charges in a capacitor C8 are discharged via a resistor R24. Further, when the transistor Tr1 is in an OFF state, the capacitor C8 is charged with an output voltage divided by bleeder resistors included in the timer circuit TM. When the transistor Tr1 is turned on/off at a low frequency and the ratio of an ON period in one cycle increases, the voltage of the capacitor C8 decreases to that extent. Therefore, the ON-time period of the switching element Q1 decreases.

Since the ratio of the ON period in one cycle of each of the transistors Tr1 and Tr2 is feedback-controlled by receiving an output detected by an output detection circuit 6, the ON-time period of the switching element Q1 is also feedback-controlled together with the burst-ON period of the switching element Q1.

A feedback control circuit includes the error AMP EA1 and the externally attached CR circuit. A feedback impedance formed with resistors R25 and R26 and a capacitor C10 is connected between the inverting input terminal and the output terminal of the error AMP EA1. A constant voltage, obtained by dividing a reference voltage Vref on pin 14 by resistors R21 and R22, is applied to the non-inverting input terminal of the error AMP EA1. The voltage of the output terminal of the error AMP EA1 is changed so that the voltages of the inverting input terminal and the non-inverting input terminal of the error AMP EA1 are identical to each other. A voltage Vdet detected by the output detection circuit 6 is inputted to the inverting input terminal of the error AMP EA1 via a first input resistor R27 while the dimming voltage Vdim is inputted to the inverting input terminal via a second input resistor R28.

When the dimming voltage Vdim increases, the output voltage of the error AMP EA1 decreases, and the ON period of the transistors Tr1 and Tr2 is lengthened, and thus a period in which the ON/OFF operations of the switching element Q1 are stopped is lengthened. Further, since the reference voltage of pin 5 of the timer circuit TM decreases, the ON-time period of the switching element Q1 is shortened. In contrast, when the dimming voltage Vdim decreases, the output voltage of the error AMP EA1 increases, and the ON period of the transistors Tr1 and Tr2 is shortened, so that the period in which the ON/OFF operations of the switching element Q1 are stopped is shortened. Further, since the reference voltage of pin 5 of the timer circuit TM increases, the ON-time period of the switching element Q1 is lengthened.

Further, even if the detected voltage Vdet varies when the dimming voltage Vdim is constant, feedback control is executed so that the variation in the output is suppressed by the above operations. That is, when the detected voltage Vdet increases, the period in which the ON/OFF operations of the switching element Q1 are stopped is lengthened while the ON-time period at the high frequency of the switching element Q1 is shortened. In contrast, when the detected voltage Vdet decreases, the period in which the ON/OFF operations of the switching element Q1 are stopped is shortened, while the ON-time period at the high frequency of the switching element Q1 is lengthened. Accordingly, a feedback control is executed such that the variation in the output is suppressed, and a control is performed such that the detected voltage Vdet corresponding to the magnitude of the dimming voltage Vdim is obtained.

Next, the output detection circuit 6 will be described. A current detection resistor R31 is connected in series to the solid-state light source 3 and a bypass circuit including a series circuit of voltage dividing resistors R32 and R34 and a zener diode ZD2 is connected in parallel to the solid-state light source 3. In the bypass circuit, a constant is set such that a bypass current, which is greater than lighting current flowing through the solid-state light source 3, flows near a dimming lower limit. Accordingly, stable dimming lighting is possible near the dimming lower limit (e.g., see Japanese Patent Application Publication No. 2011-65922).

When the lighting current flowing through the solid-state light source 3 increases or decreases, the voltage between two ends of the resistor R31 increases or decreases. Further, when the voltage applied to the solid-state light source 3 increases or decreases, the voltage between two ends of the resistor R32 increases or decreases. Therefore, when the lighting current or the applied voltage of the solid-state light source 3 increases or decreases, the voltage between two ends of the series circuit of the resistors R31 and R32 increases or decreases.

Since a voltage, obtained by subtracting the base-emitter voltage of a transistor Tr3 from the voltage between two ends of the series circuit of the resistors R31 and R32, is applied to the resistor R33, a base current corresponding to the voltage between two ends of the series circuit of the resistors R31 and R32 flows through the transistor Tr3. Since a collector current based on the base current flows through a series circuit of resistors R35 and R36, the detected voltage Vdet is a voltage that incorporates both the lighting current and the applied voltage of the solid-state light source 3.

Further, when the value of the resistor R31 is zero, the output detection circuit 6 functions as a voltage detection circuit. When the value of the resistor R32 is zero, the output detection circuit 6 functions as a current detection circuit. Furthermore, when the values of the resistors R31 and R32 are properly set, the output detection circuit 6 functions as a circuit for detecting a load power in a similar manner.

A current corresponding to the sum of the lighting current flowing through the solid-state light source 3 and the bypass current flowing through the bypass circuit flows through the resistor R31. Therefore, even if the lighting current flowing through the solid-state light source 3 is close to zero, a voltage (a boost voltage) caused by the bypass current flowing through the bypass circuit is generated in the resistor R31, thus preventing the transistor Tr3 from being cut off.

Further, the zener voltage of the zener diode ZD2 is set to a voltage lower than the voltage at which the solid-state light source 3 can be turned on. Accordingly, when the solid-state light source 3 is turned on, the voltage is necessarily generated in the resistor R32, thus preventing the transistor Tr3 from being cut off.

In this way, the output detection circuit 6 in FIG. 14 uses the bypass current flowing through the bypass circuit as a bias current required to conduct the base-emitter diode of the transistor Tr3 for output detection. Therefore, even if the lighting current or the applied voltage of the solid-state light source 3 is low, the transistor Tr3 for output detection is prevented from being cut off, and is biased to be always operated in an active region.

Further, it is also preferable to individually detect the lighting current and the applied voltage of the solid-state light source 3 and to perform the feedback control to the first error AMP EA1 based on the lighting current while performing feedback control to the second error AMP EA2 based on the applied voltage. It is well known that it is profitable to perform the former control between high luminance level and medium luminance level and perform the latter control at a low luminance level (e.g., see Japanese Patent Application Publication No. 2009-232623).

In the embodiments of the present invention described above, an LED has been exemplified as the solid-state light source 3, it is not limited thereto and may be, e.g., an OLED (organic light emitting diode) or a semiconductor laser element.

Although a MOSFET has been exemplified as the switching element Q1, the switching element is not limited thereto and may be, e.g., an IGBT (Insulated Gate Bipolar Transistor) or the like.

Figure 16A:
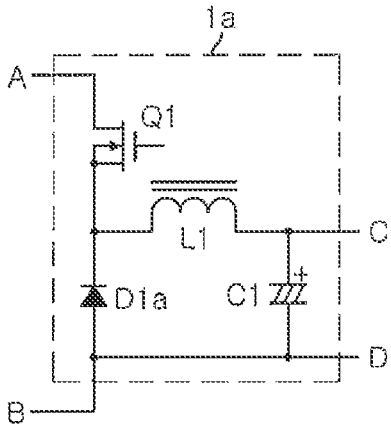
FIGS. 16A to 16D are circuit diagrams showing examples of the configuration of a DC power circuit unit used in the present invention.
Figure 16B:
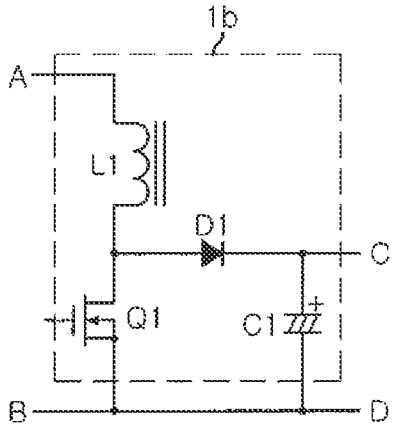
Figure 16C:
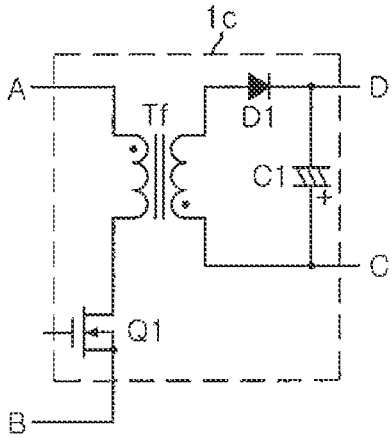
Figure 16D:
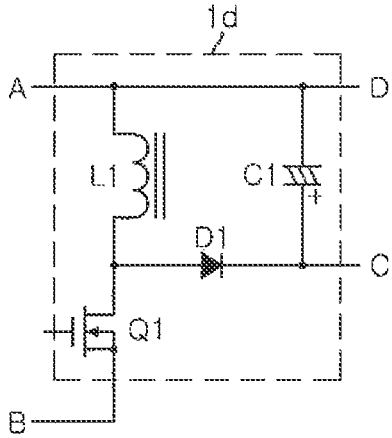

In the above-described embodiments, the DC power circuit unit 1 as the buck chopper circuit, in which the switching element Q1 is arranged on a low-potential side has been described, it is apparent that the present invention can be applied to a case where a switching element Q1 of a buck chopper circuit 1*a* is arranged on a high-potential side, as shown in FIG. 16A. Further, it is also possible to use various types of switching power supply circuits, shown in FIGS. 16B to 16D, as the DC power circuit unit 1 of the present invention. FIGS. 16B, 16C and 16D respectively illustrate examples of a boost chopper circuit 1*b*, a flyback converter circuit 1*c*, and a buck-boost chopper circuit 1*d*.

While the invention has been shown and described with respect to the embodiments, the present invention is not limited thereto. It will be understood by those skilled in the art that various changes and modifications may be made without departing from the scope of the invention as defined in the following claims.

What is claimed is:

1. A lighting device for lighting a solid-state light source, comprising:

a DC power circuit unit for converting a power of an input DC power source using a switching element and flowing a current through a solid-state light source; and a control unit for performing a first switching control in which the switching element is turned on/off at a first high frequency, and a second switching control in which an ON/OFF operation of the switching element is intermittently stopped at a second frequency which is lower than the first frequency of the first switching control, wherein when the current flowing through the solid-state light source is changed, the second frequency is varied.

2. The lighting device of claim 1, wherein when the first frequency becomes higher, the control unit raises the second frequency.

3. The lighting device of claim 1, wherein when the current flowing through the solid-state light source is less than a predetermined value, the control unit controls the first frequency to be almost constant.

4. The lighting device of claim 1, wherein when the current flowing through the solid-state light source is less than a predetermined value, the control unit controls an ON-time period of the switching element in the first switching control to be almost constant.

5. The lighting device of claim 1, wherein when the current flowing through the solid-state light source is less than a predetermined value, the control unit raises the second frequency as the first frequency becomes higher, whereas when the current flowing through the solid-state light source is equal to or greater than the predetermined value, the control unit controls the second frequency to be almost constant.

6. The lighting device of claim 1, wherein the DC power circuit unit is configured such that an inductor is connected in series to the switching element and the current flows through the solid-state light source by using a charging current and a discharging current of the inductor, and the switching element is controlled by the first switching control so that the current of the inductor is in a zero-crossing operation or in a discontinuous operation close to the zero-crossing operation.

7. The lighting device of claim 1, wherein the DC power circuit unit includes capacitive impedance connected in parallel to the solid-state light source and the second frequency is set such that the current flowing through the solid-state light source forms a continuous waveform.

8. The lighting device of claim 1, further comprising a capacitor for smoothing a control signal of the second frequency, wherein the first frequency is set based on a voltage of the capacitor.

9. An illumination apparatus comprising the lighting device described in claim 1.

10. The lighting device of claim 1, wherein the second switching control includes a burst ON/OFF control having a burst ON period and a burst OFF period, and wherein the switching element is turned on/off at the first high frequency during the burst ON period and the ON/OFF operation of the switching element is stopped during the burst OFF period.

* * * * *